US009295329B2

(12) United States Patent
Brunnmayr et al.

(10) Patent No.: US 9,295,329 B2
(45) Date of Patent: Mar. 29, 2016

(54) DRIVE DEVICE FOR A MOVABLE FURNITURE PART

(71) Applicant: Julius Blum GmbH, Hoechst (AT)

(72) Inventors: Harald Brunnmayr, Hoerbranz (AT); Florian Fischer, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/568,347

(22) Filed: Dec. 12, 2014

(65) Prior Publication Data

US 2015/0097473 A1 Apr. 9, 2015

Related U.S. Application Data

(63) Continuation of application No. PCT/AT2013/000088, filed on May 10, 2013.

(30) Foreign Application Priority Data

Jul. 10, 2012 (AT) ..... A 767/2012

(51) Int. Cl.
*A47B 88/04* (2006.01)

(52) U.S. Cl.
CPC ..... *A47B 88/0481* (2013.01); *A47B 88/047* (2013.01)

(58) Field of Classification Search
CPC ..... A47B 88/0481; A47B 88/0477; A47B 88/047; A47B 2088/0474
See application file for complete search history.

(56) References Cited

U.S. PATENT DOCUMENTS

| | | | | |
|---|---|---|---|---|
| 7,802,856 | B2 * | 9/2010 | Hashemi et al. | 312/334.46 |
| 8,100,487 | B2 * | 1/2012 | Liang et al. | 312/333 |
| 2007/0120380 | A1 | 5/2007 | Bella | |
| 2009/0273263 | A1 * | 11/2009 | Berger | 312/334.1 |
| 2011/0012488 | A1 * | 1/2011 | Liang et al. | 312/319.1 |
| 2012/0038255 | A1 * | 2/2012 | Netzer et al. | 312/319.1 |

(Continued)

FOREIGN PATENT DOCUMENTS

| | | |
|---|---|---|
| AT | 511 329 | 11/2012 |
| CN | 202262655 | 6/2012 |

(Continued)

OTHER PUBLICATIONS

International Search Report (ISR) issued Dec. 4, 2013 in International (PCT) Application No. PCT/AT2013/000088.

(Continued)

*Primary Examiner* — Daniel J Troy
*Assistant Examiner* — Andrew Roersma
(74) *Attorney, Agent, or Firm* — Wenderoth, Lind & Ponack, L.L.P.

(57) ABSTRACT

A drive device for a movable furniture part includes a latching element which is movable in a slotted guide track shaped as a cardioid. The slotted guide track has a closing section in which the latching element moves during the closing of the movable furniture part, a locking section with a latching trough, in which the latching element is held in the locking position, an opening section in which the latching element is movable during the opening of the movable furniture part, and a first connecting section via which the latching element is movable from the opening section into the closing section when the furniture part is open. A second connecting section, which is formed closer to the latching trough, is located between opening section and closing section.

20 Claims, 29 Drawing Sheets

(56) References Cited

U.S. PATENT DOCUMENTS

| | | | | |
|---|---|---|---|---|
| 2013/0134852 | A1* | 5/2013 | Salice | 312/319.1 |
| 2014/0021841 | A1 | 1/2014 | Brunnmayr | |

FOREIGN PATENT DOCUMENTS

| | | | | | |
|---|---|---|---|---|---|
| DE | 20 2008 001 884 | | | 4/2008 | |
| DE | 20 2009 005 256 | | | 11/2010 | |
| DE | 202009004955 | U1 | * | 12/2010 | A47B 88/00 |
| DE | 202009005256 | U1 | * | 12/2010 | A47B 88/04 |
| DE | 20 2009 005 233 | | | 1/2011 | |
| EP | 1 314 843 | | | 5/2003 | |
| EP | 2208440 | A1 | * | 7/2010 | A47B 88/04 |
| EP | 2208441 | A1 | * | 7/2010 | A47B 88/04 |
| EP | 2 272 400 | | | 1/2011 | |
| EP | 2272400 | A1 | * | 1/2011 | A47B 88/04 |
| EP | 2 292 119 | | | 3/2011 | |
| JP | 4-64677 | | | 2/1992 | |
| JP | H09-250870 | A | * | 9/1997 | F25D 25/02 |
| JP | 11-217048 | | | 8/1999 | |
| WO | WO2012071328 | A1 | * | 5/2012 | A47B 57/20 |
| WO | WO 2012130652 | A1 | * | 10/2012 | A47B 88/04 |
| WO | WO 2012149587 | A1 | * | 11/2012 | A47B 88/04 |

OTHER PUBLICATIONS

Austrian Patent Office Search Report (ASR) issued Mar. 11, 2013 in Austrian Patent Application No. A 767/2012.

Chinese Search Report issued Nov. 24, 2015 in corresponding Chinese Application No. 201380036600.7.

* cited by examiner

55
54
12
50
13
43
6
IV
II
III
20
F
48
IX
X
V
VIII
52
4
SR
45
49
53
VI
I
6
51
VII
56

VS

DRIVE DEVICE FOR A MOVABLE FURNITURE PART

BACKGROUND OF THE INVENTION

The invention concerns a drive device for a moveable furniture part comprising a latching element displaceable in a cardioid curve-like sliding track. The sliding track has a closing portion in which the latching element moves upon closing of the moveable furniture part, a locking portion having a latching recess in which the latching element is held in the locking position, an opening portion in which the latching element is displaceable upon opening of the moveable furniture part, and a first connecting portion, by way of which the latching element is moveable from the opening portion into the closing portion when the furniture part is opened. The invention also concerns an article of furniture comprising a furniture carcass, a moveable furniture part and such a drive device for the moveable furniture part.

Drive devices for moveable furniture parts in the form of lockable ejection devices have already been known for many years in the furniture fitting industry. In that case, unlocking of the ejection device is triggered by movement (pushing or pulling) of the moveable furniture part out of the closed position, whereby the moveable furniture part is automatically ejected or opened.

In that respect, locking by way of a sliding track in the form of a cardioid curve has become established as the common kind of locking action. The latching element connected to an ejection element is held in the locking portion of that sliding track, whereby the moveable furniture part is in the closed position. By pressing against the moveable furniture part, the latching element is also moved out of the locking portion and passes into an opening portion. As soon as that is reached, an ejection force storage means can be relieved of stress and ejects the moveable furniture part in the opening direction. In that respect, that opening portion is approximately as long as the ejection travel of the ejection force storage means. As soon as the ejection force storage means has been completely unloaded, therefore, the latching element is also disposed at the end of the opening portion of the sliding track. From that position, the moveable furniture part can be further opened manually in a freely running movement.

In a closing movement or active retraction movement by way of a retraction device, the latching element is not moved back through the opening portion again, but is deflected into a closing portion by the configuration of the sliding track. For that purpose, a transitional region is provided between the opening portion and the closing portion. That transitional region can also be referred to as a connecting portion. In commonly used drive devices, the opening portion has a length of between about 3 cm and 20 cm between the latching recess and the first connecting portion. That travel distance, however, can be individually adjusted and is dependent on the size of the moveable furniture part and other parameters.

In order to restore secure locking of the latching element in the latching recess, the latching element or the control projection has to be moved through the closing portion in known drive devices with a cardioid curve-like sliding track (see for example Austrian patent application A 614/2011) which is of earlier priority and which forms a prior right. If however the ejection movement is interrupted because of incorrect operation, for example by the moveable furniture part still being stopped during the ejection movement, the latching element remains in the opening portion. If now the operator wants to close the furniture part again, it is no longer possible for locking of the latching element to take place in the latching recess as the latching element cannot move from the opening portion into the locking portion by virtue of the configuration of the sliding track. Secure locking would only be possible if the operator moves the moveable furniture part in the opening direction until the latching element has reached the first connecting portion and the latching element passes into the closing portion upon the furniture part being closed again.

SUMMARY OF THE INVENTION

The object of the present invention is therefore to provide a drive device which is improved over the state of the art. In particular, the invention seeks to provide that in the event of incorrect operation, locking of the latching element in the locking portion is possible in an easy fashion even if the ejection process is interrupted.

According to the invention therefore there is provided a second connecting portion, which is closer to the latching recess, between the opening portion and the closing portion. In other words, in the event of incorrect operation of the latching element, it is not necessary to travel along the entire cardioid curve-like sliding track. Instead, there is a short cut in the shape of the second connecting portion through the "heart" of the cardioid curve-like sliding track.

To prevent unwanted entry of the latching element from the closing portion into the second connecting portion, a deflection element which is preferably of a flap-like configuration is arranged between the second connecting portion and the closing portion. That deflection element is preferably spring-loaded, the deflection element moving only when the latching element, coming from the second connecting portion, encounters the deflection element.

To guarantee the deflection of the latching element into the second connecting portion, the opening portion has an inclined deflecting means by which the latching element can be deflected in the opening movement into a part of the opening portion, which part is between the first and the second connecting portion. That deflection guarantees that the latching element passes into the second connecting portion upon movement of the latching element in the closing direction in the part of the opening portion, that is between the first and the second connecting portion.

In a further preferred embodiment, the sliding track is provided in a housing of the drive device, wherein an ejection element which is acted upon by an ejection force storage means for the moveable furniture part is moveable relative to the housing. To allow the movement of the latching element in the sliding track, the latching element is mounted moveably, preferably pivotably, to the ejection element.

Protection is also claimed for an article of furniture comprising a furniture carcass, a moveable furniture part, and a drive device according to the invention for the moveable furniture part. Depending on the respective configuration of the drive device, the drive device can be arranged on the furniture carcass and in that way the moveable furniture part is actively ejected. Alternatively, the drive device can be arranged on the moveable furniture part, whereby the drive device is ejected from the furniture carcass.

BRIEF DESCRIPTION OF THE DRAWINGS

Further details and advantages of the present invention are described more fully hereinafter via the specific description with reference to the exemplary embodiments illustrated in the drawings, in which.

DETAILED DESCRIPTION OF THE INVENTION

Figure 1:
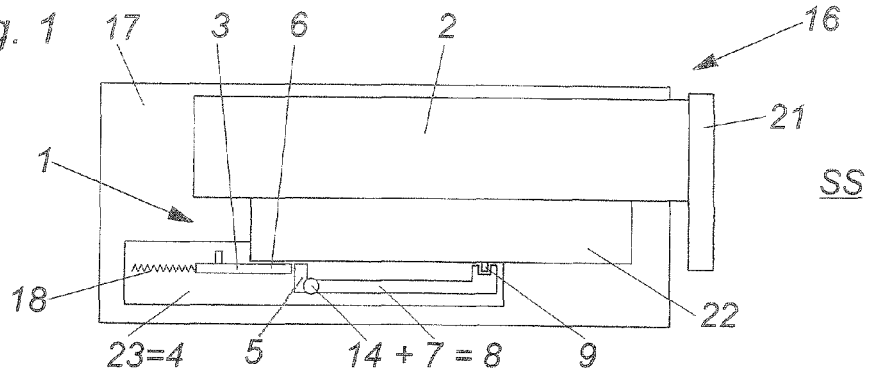
FIGS. 1 through 4 diagrammatically show a moveable furniture part in various positions with a drive device.

FIG. 1 diagrammatically shows an article of furniture 16 comprising a furniture carcass 17 and a moveable furniture part 2, at the front side of which is mounted a front panel 21. The moveable furniture part 2 is mounted moveably by a drawer rail 22 to a carcass rail 23—possibly also by way of a central rail (not shown). In this diagrammatic view, the carcass rail 23 at the same time forms the housing 4 of the drive device 1. In this FIG. 1, the entire drive device 1 is associated with the furniture carcass 17, only the entrainment member 9 moves with the moveable furniture part 2. In principle, the arrangement can also be precisely reversed so that the drive device 1 is associated with the moveable furniture part 2 while the entrainment member 9 is arranged fixed with respect to the furniture carcass. The position of the moveable furniture part 2—especially the entrainment member 9—is detected by a detection device 7 and passed to the locking element 5 by the transmission slide 14 which in this case is shown as a circle. The transmission slide 14 and the detection device 7 together with possible further components form the transmission device 8 for transmission of the position of the moveable part 2, detected by the detection device 7, to the locking element 5. The ejection element 3 (this can also be referred to as the ejection slide 3) is mounted moveably on the housing 4 and is acted upon by an ejection force storage member 18 in the opening direction OR. As the movement of the ejection element 3 in the opening direction OR is blocked by the locking element 5, the moveable furniture part 2 cannot be ejected in the opening direction OR whereby the moveable furniture part 2 is in the closed position SS.

Figure 2:
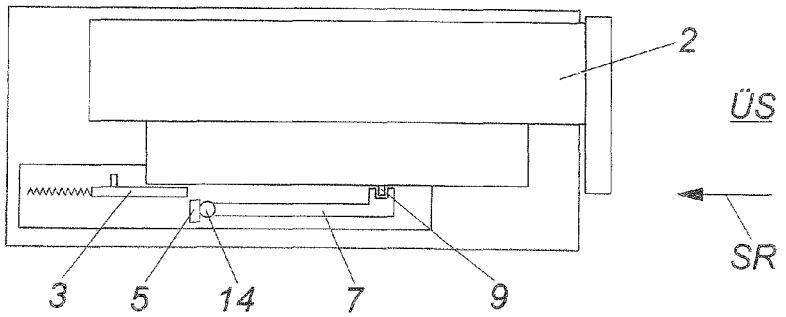

If now a pressure is applied to the moveable furniture part 2 in the closing direction SR as shown in FIG. 2, the locking element 5 is moved by the transmission device 8 so that the ejection path for the ejection element 3 is cleared. In the event of over-pressing in the closing direction SR, the locking element 5 does not necessarily have to be moved, as in FIGS. 1 through 4 and FIGS. 23 through 29. Rather, the position of the moveable furniture part 2 can be passed by the detection device 7 directly to the latching element 6 arranged on the ejection element 3 so that it is moved out of the latching recess 13 of a cardioid-shaped sliding track 12 into an opening portion 45 of the sliding track 12, as shown in FIGS. 5 through 22. The over-pressed position ÜS is reached by that over-pressing action.

Figure 3:
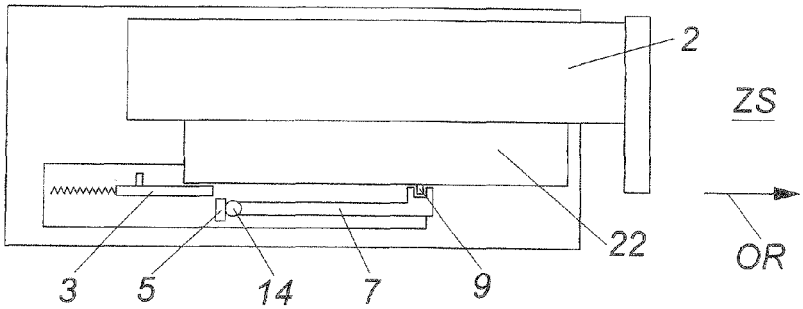

In comparison, FIG. 3 shows a drive device 1 which is unlocked by pulling on the moveable furniture part 2 in the opening direction OR. That opening movement is also detected by the detection device 7 whereby the locking element 5 is moved relative to the housing 4 by a transmission device 8 separate from the latching element 6 and thereby clears the ejection path for the ejection element 3. The pulling position ZS which is directly in front of the closed portion SS is reached thereby.

Figure 4:
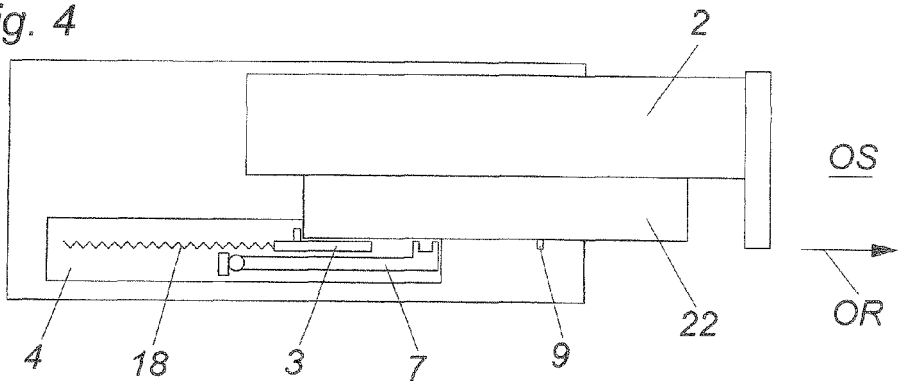

In FIG. 4 the ejection element 3, after unlocking thereof by pressing (as shown in FIG. 2) or by pulling (FIG. 3), due to the ejection force storage member 18 being relieved of stress, has ejected the moveable furniture part 2 in the opening direction OR, whereby an open position OS is reached. Upon ejection, the entrainment member 9 comes out of engagement from the detection device 7. That can be effected by the catch lever 37 of the detection device 7 being pivoted away.

Figure 5:
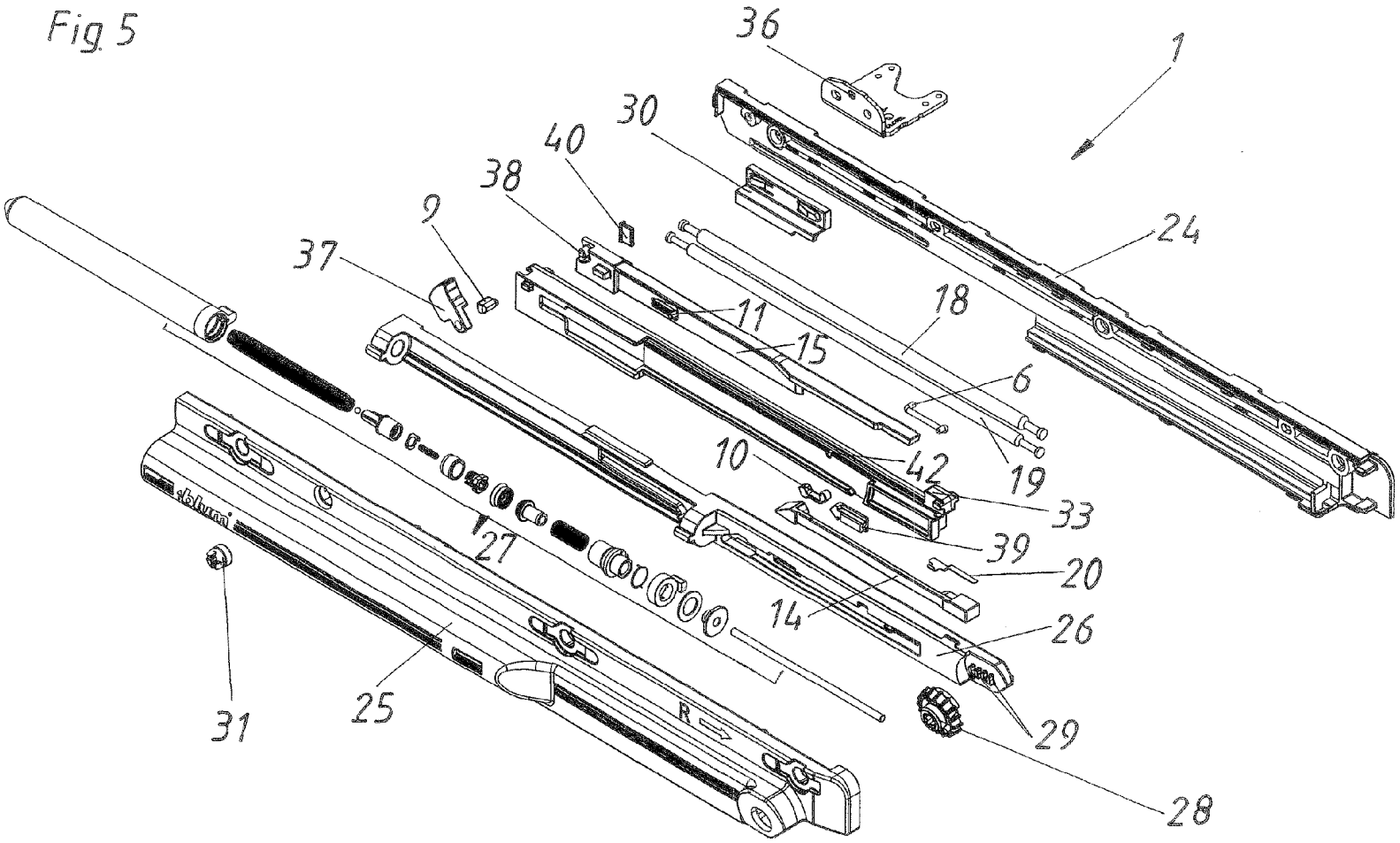
FIGS. 5 through 6 show exploded views of a drive device.
Figure 6:
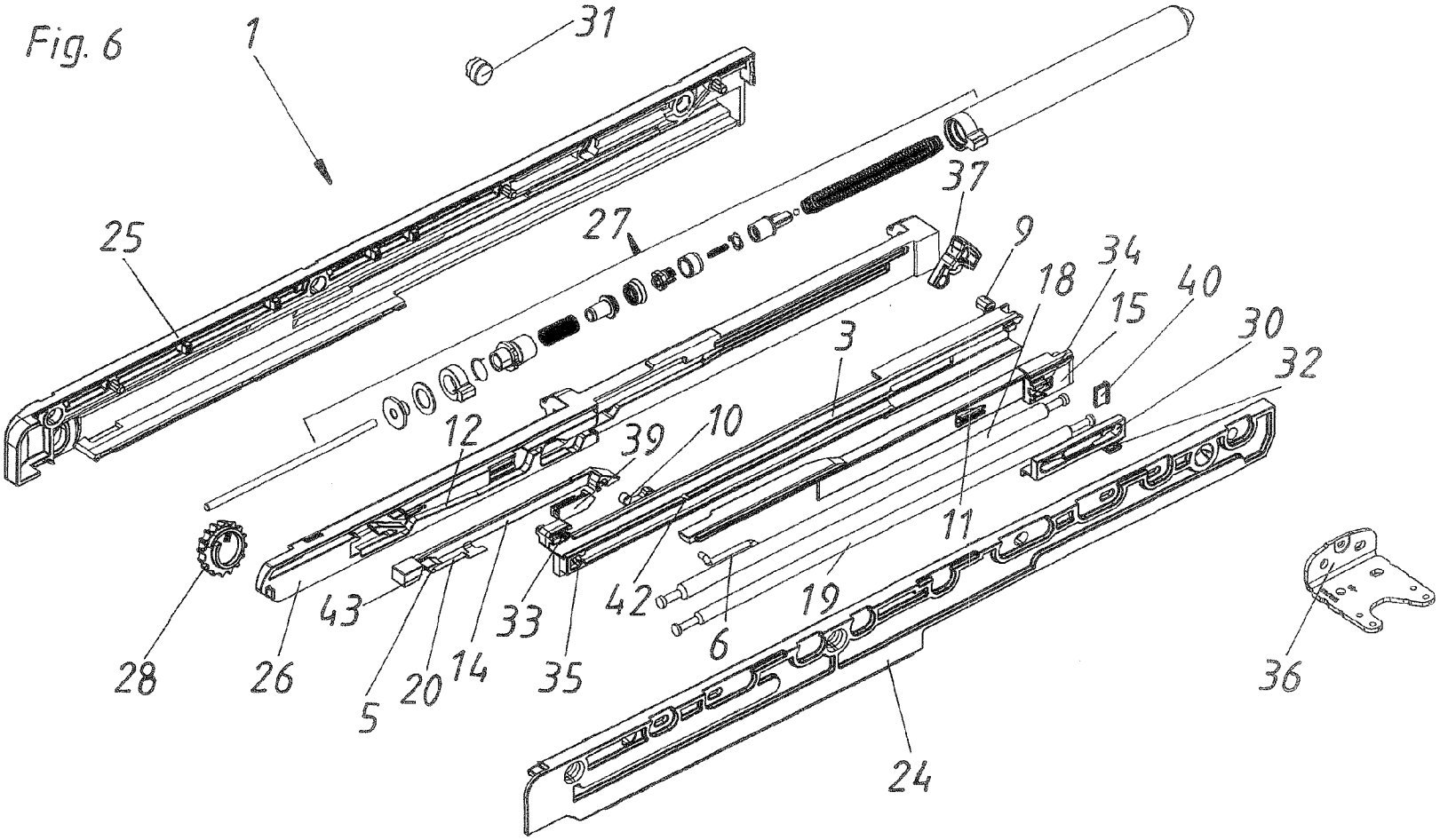

Exploded views of a specific embodiment by way of example of a drive device 1 are shown in FIGS. 5 and 6. In that case the housing base plate 24, the housing center plate 26, and the housing cover 25 together form the housing 4, and the housing 4 is preferably mounted to a drawer rail 22 by the housing base plate 24. To achieve a change in position of the moveable furniture part 2 in its closed position SS relative to the furniture carcass 17, the housing center plate 26 can be displaced relative to the components fixed with respect to the furniture part, the housing base plate 24 and the housing cover 25. In that case, precise setting is possible by the adjusting element 28 and the adjusting studs on the housing center plate 26. A damping device 27 for damping the retraction movement of the moveable furniture part 2 is also connected to the housing center plate 26. The individual components of that damping device 27 are not identified in greater detail.

The sliding track 12 in which the latching element 6 moves is provided in the housing center plate 26 and thus in the housing 4. The latching element is held pivotably at one end at the mounting location 42 in the ejection element 3. The ejection element 3 is moveable between abutments relative to the housing center plate 26. The spring base 33 for the ejection force storage means 18 (tension spring) is provided on that ejection element 3. The other end of the ejection force storage member 18 is held to the spring base 32. That spring base 32 is disposed at the spring stressing element 30 fixedly connected to the housing base plate 24. The spring stressing force can be adjusted in dependence on the location of fixing of the spring stressing element 30 to the housing base plate 24. The spring stressing element 30 arranged on the housing base plate 24 can be moved relative to the housing base plate 24 by the second adjusting element 31 and thus the spring stressing force of the ejection force storage member 18 can be adjusted.

A spring base 35 for the retraction force storage member 19 (tension spring) is also disposed on the ejection element 3, the retraction force storage member being fixed on the other hand to the spring base 34 on the retraction slide 15. That retraction slide 15 (it can also be referred to as the retraction device 15) is movably mounted to the ejection slide 3 with limited movement due to abutments. At one end of the retraction slide 15 is disposed the axis of rotation 38 for the catch lever 37. The entrainment member 9 is held by way of that catch lever 37—which is part of the detection device 7. The entrainment member 9 is fixedly connected to the mounting plate 36 which is mounted to the carcass rail 23 (not shown). A damping abutment 40 is also provided at the end of the retraction slide 15 so that upon contact occurring between the retraction slide 15 and the entrainment member 9, no loud noise occurs and the components are handled gently.

The transmission slide 14 mounted moveably on the housing center plate 26 is provided for travel-controlled triggering of the ejection slide 3 or for travel-controlled nullification of the locking action upon pulling on the moveable furniture part. At one end, the slide 14 has the locking element 5 which in part also forms the latching recess 13 of the sliding track 12. The inclined deflection means 43 which also forms the sliding track 12 for the over-pressing effect is also provided on that transmission slide 14. The elastic coupling element 10 is held at the front end of the transmission slide 14, the coupling element 10 corresponding to the connecting element 11 provided on the retraction slide 15. Also arranged on the transmission slide 14 is the deflection element 20, by way of which the latching element 6 can be moved back into the closed position SS in the event of the ejection movement not being complete. The slider 39 which is mounted resiliently on the housing center plate 26 ensures that the latching element 6 does not pass into an unwanted portion of the sliding track 12, in particular when the drawer is thrown shut with too little energy and is ejected again before locking takes place. In such a movement, the slider 39 remains closed.

Figure 7:
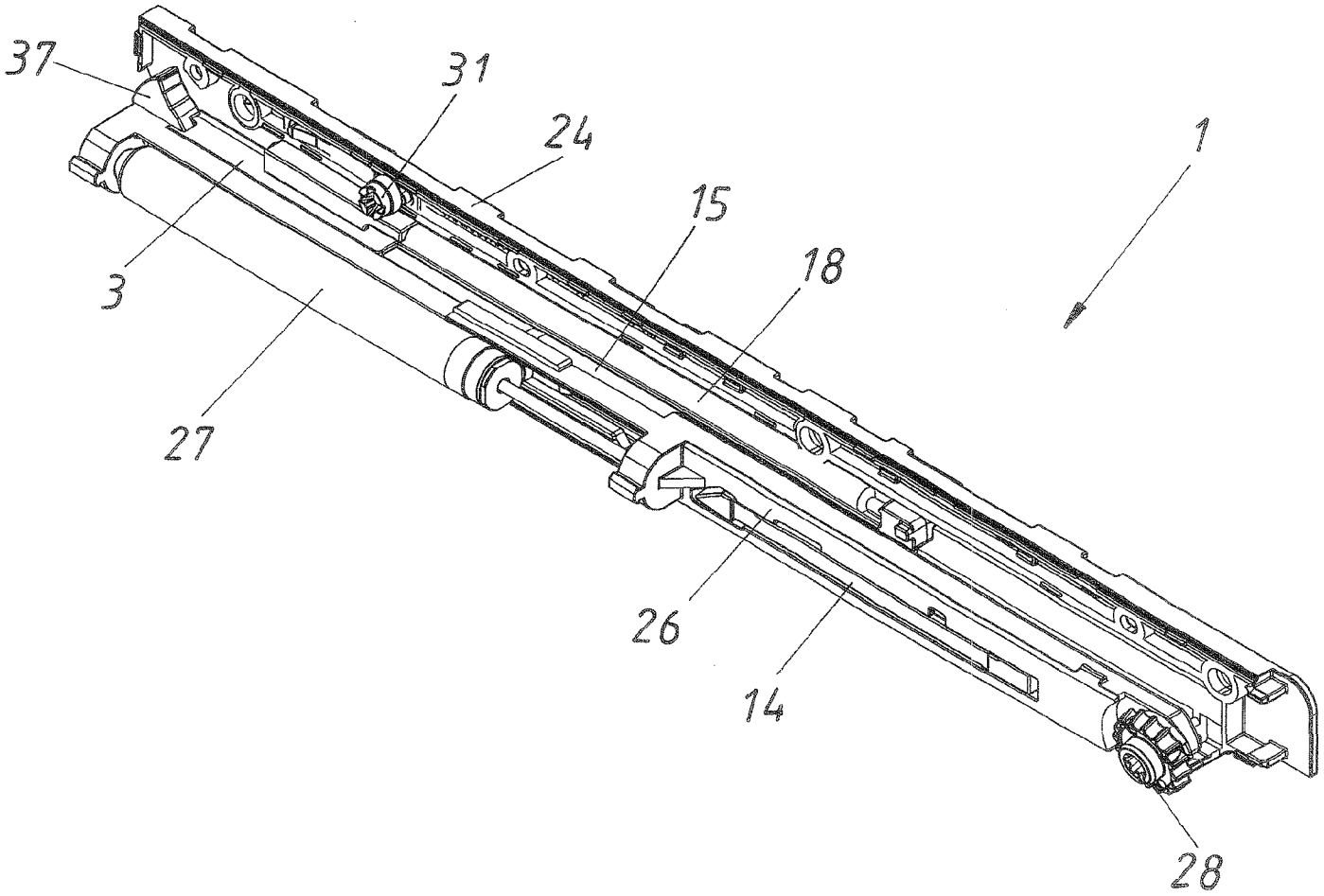
FIGS. 7 through 12 show various broken-away 3D views of the drive device.

FIG. 7 shows the drive device 1 in the assembled condition, with the housing cover 25 removed. It will be seen that the damping device 27 is clamped in the housing center plate 26. It is also possible to see the ejection force storage member 18 which is fixed on the one hand to the housing base plate 24 or to the spring stressing element 30 and on the other hand to the ejection slide 3. The retraction slide 15 and the catch lever 37 fixed thereto can also be partly seen. The large part of the transmission slide 14 is also visible through the housing center plate 26.

Figure 8:
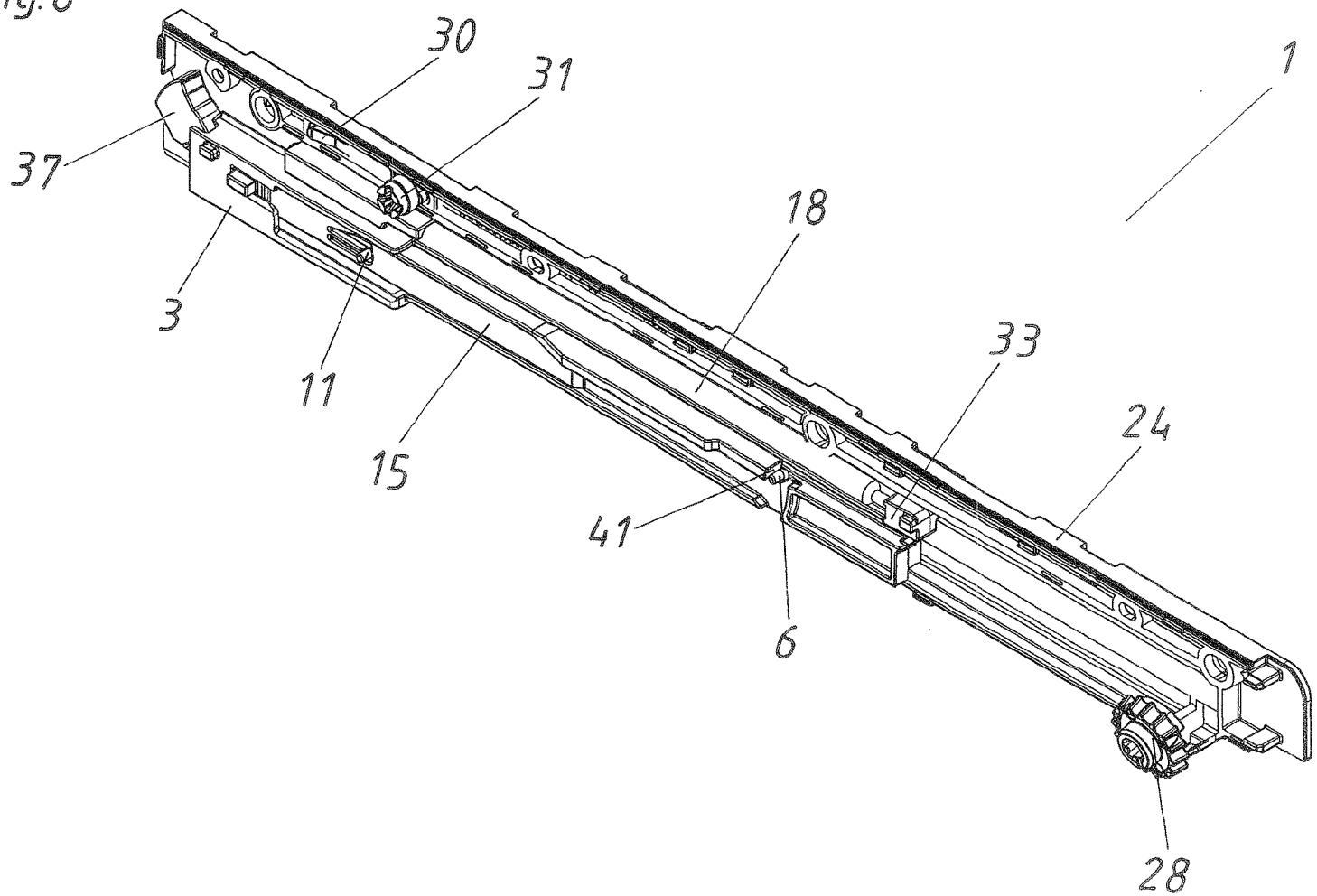

The housing center plate 26 is removed in FIG. 8 in comparison with FIG. 7, thereby ensuring a better view of the ejection slide 3 and the retraction slide 15.

It will be seen that the latching element 6 bears against an end of the retraction slide 15—which is formed by the latching element abutment 41. The latching element 6 cannot escape from that position as it is guided in the sliding track 12.

Figure 9:
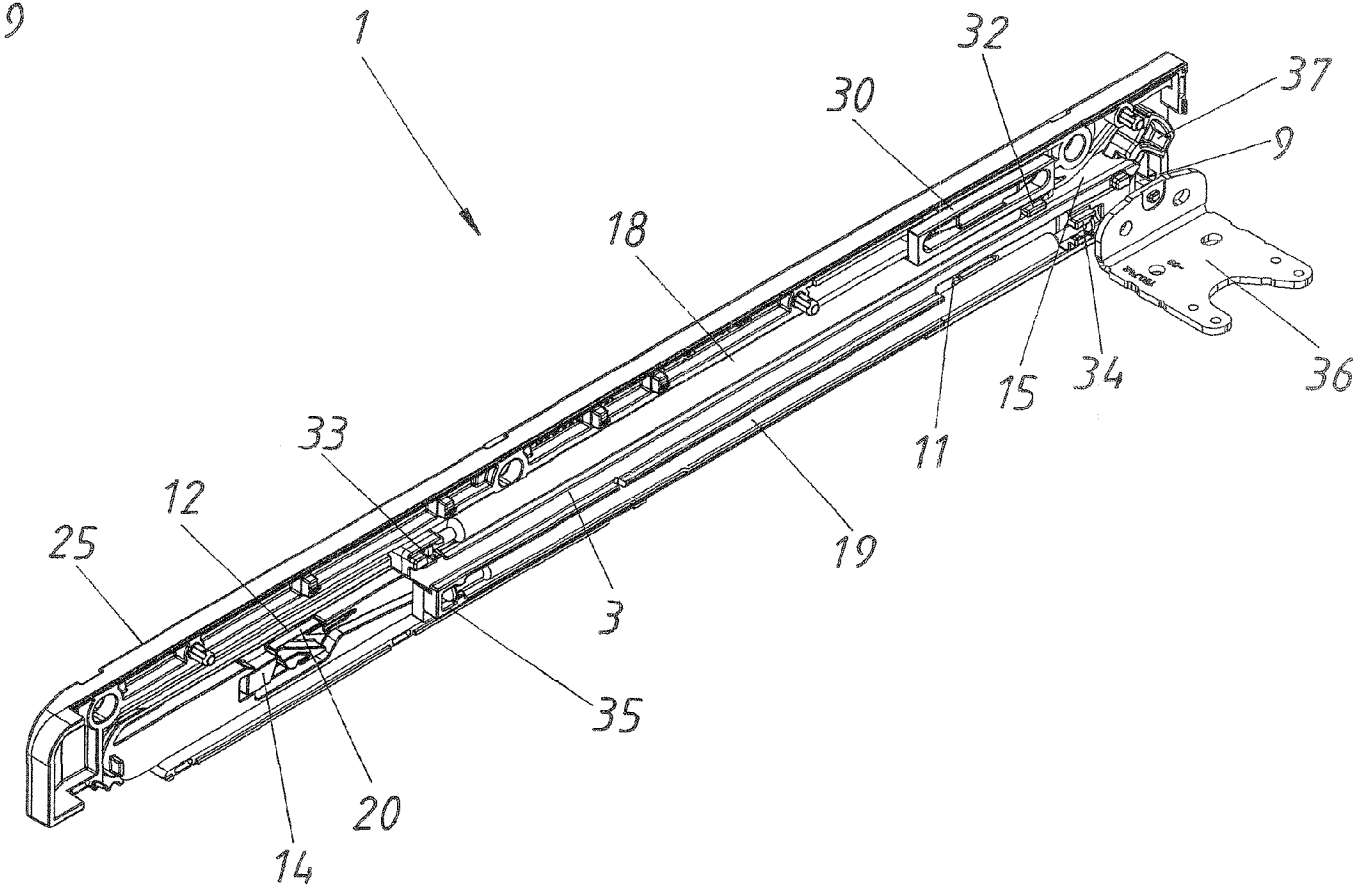

That sliding track 12 is visible for the major part in FIG. 9 in which, of the drive device 1, only the housing base plate 24 is missing. The retraction force storage member 19 which is in the form of a tension spring is in this case held between the spring bases 34 and 35. The ejection force storage member 18 is held to the spring bases 32 and 33. The catch lever 37 is shown in the opened position, wherein the entrainment member 9 already bears against the abutment 40 of the retraction slide 15.

Figure 10:
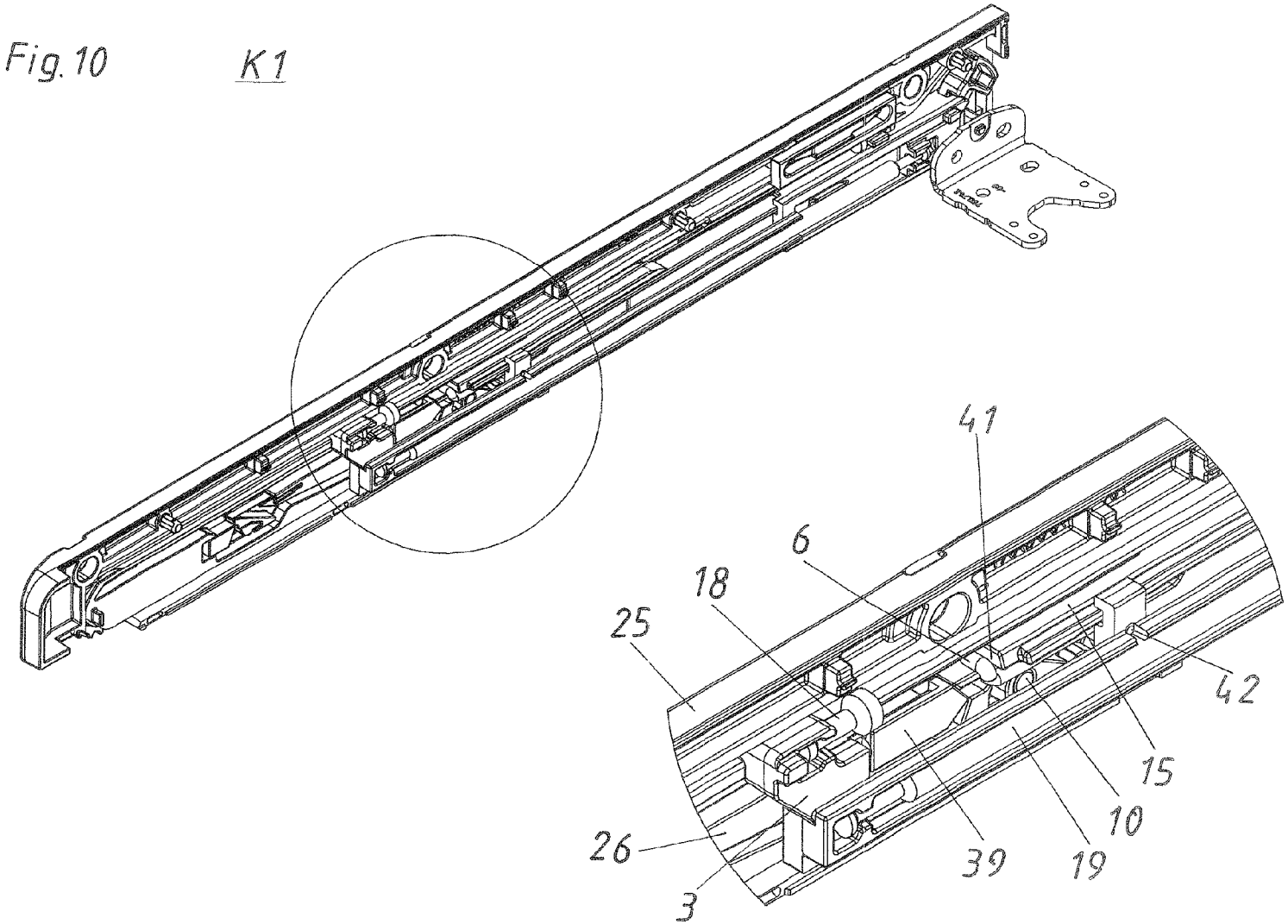

To give a better view in relation to the latching element 6, a part of the ejection slide 3 is removed in FIG. 10 in contrast to FIG. 9. As a result, it can be seen that the latching element 6 bears against the sliding track 12 and the latching element abutment 41. In this first coupling position K1 of the latching element 6, the retraction slide 15 is coupled to the ejection slide 3 as the retraction slide 15, by virtue of the latching element abutment 41 bearing against the latching element 6, cannot move further towards the left relative to the ejection slide 3. As a result, the retraction force storage member 19 cannot be relieved of stress.

Figure 11:
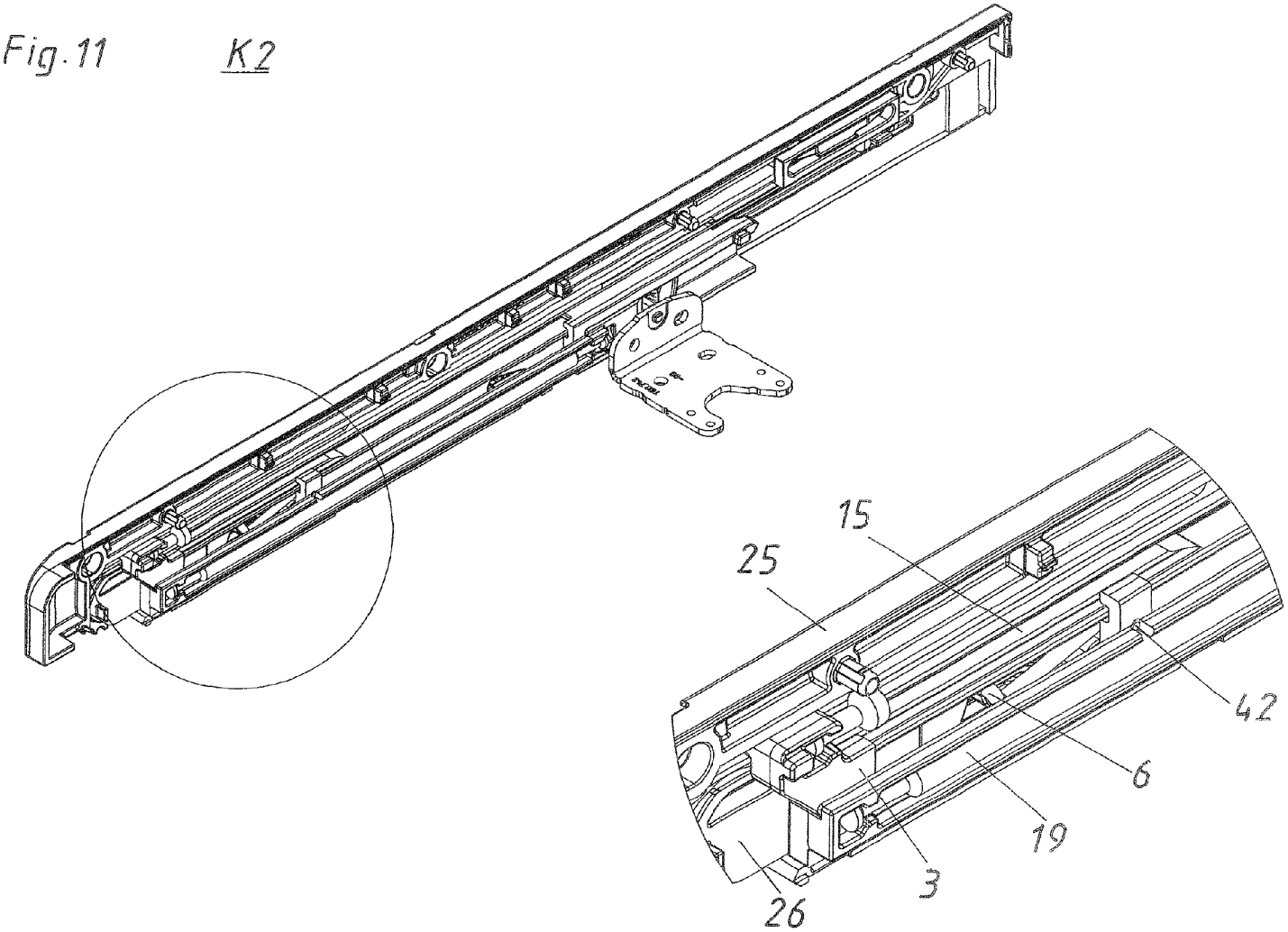

In contrast, in FIG. 11, the retraction force storage member 19 is relaxed as the latching element 6 has reached the second coupling position K2 in which the path for the retraction slide 15 relative to the ejection slide 3 has been cleared.

Figure 12:
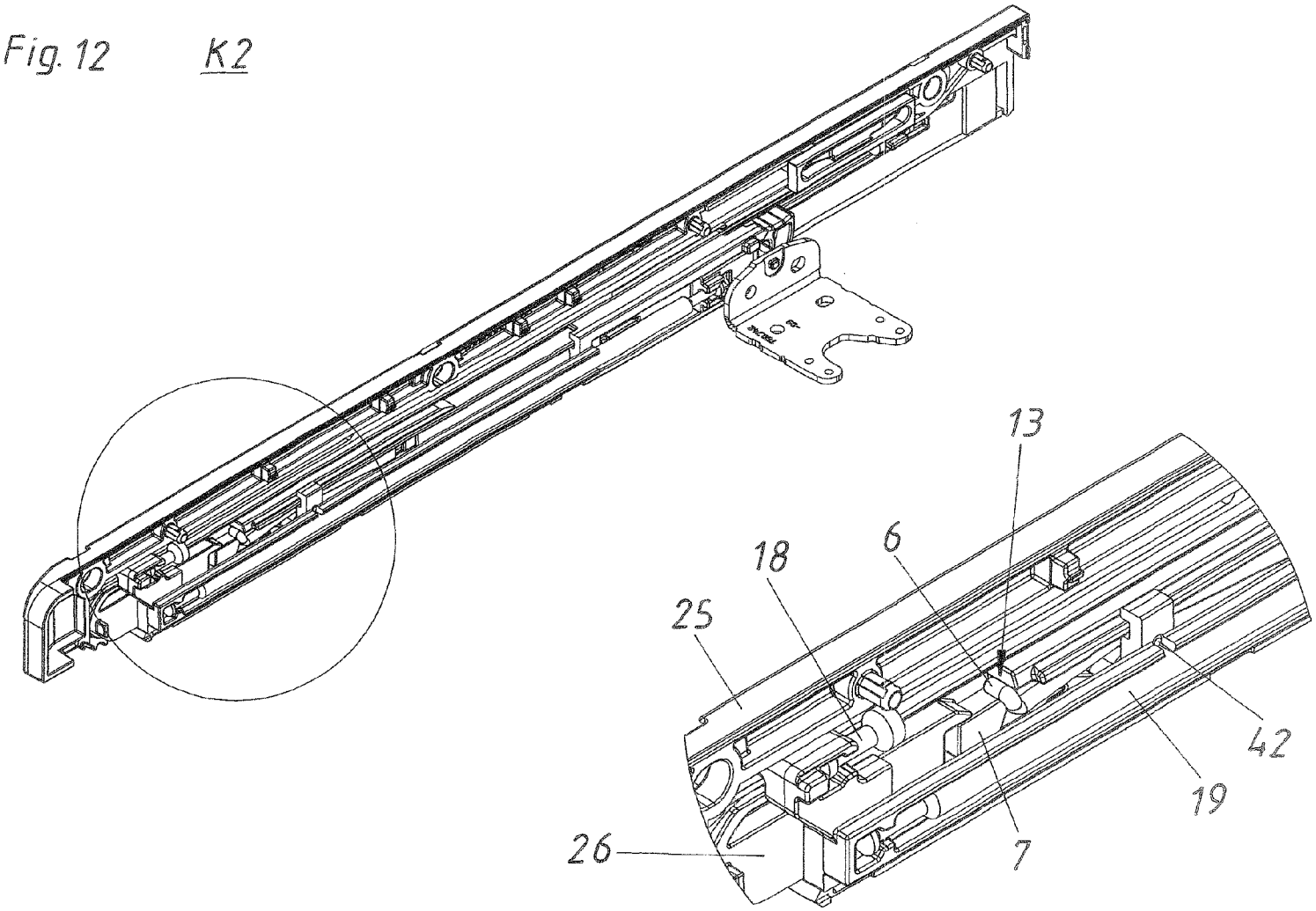

In conformity therewith, the retraction slide 15 is partly removed in FIG. 12 so that there is a clear view to the latching element 6 held in or on the latching recess 13.

Figure 13:
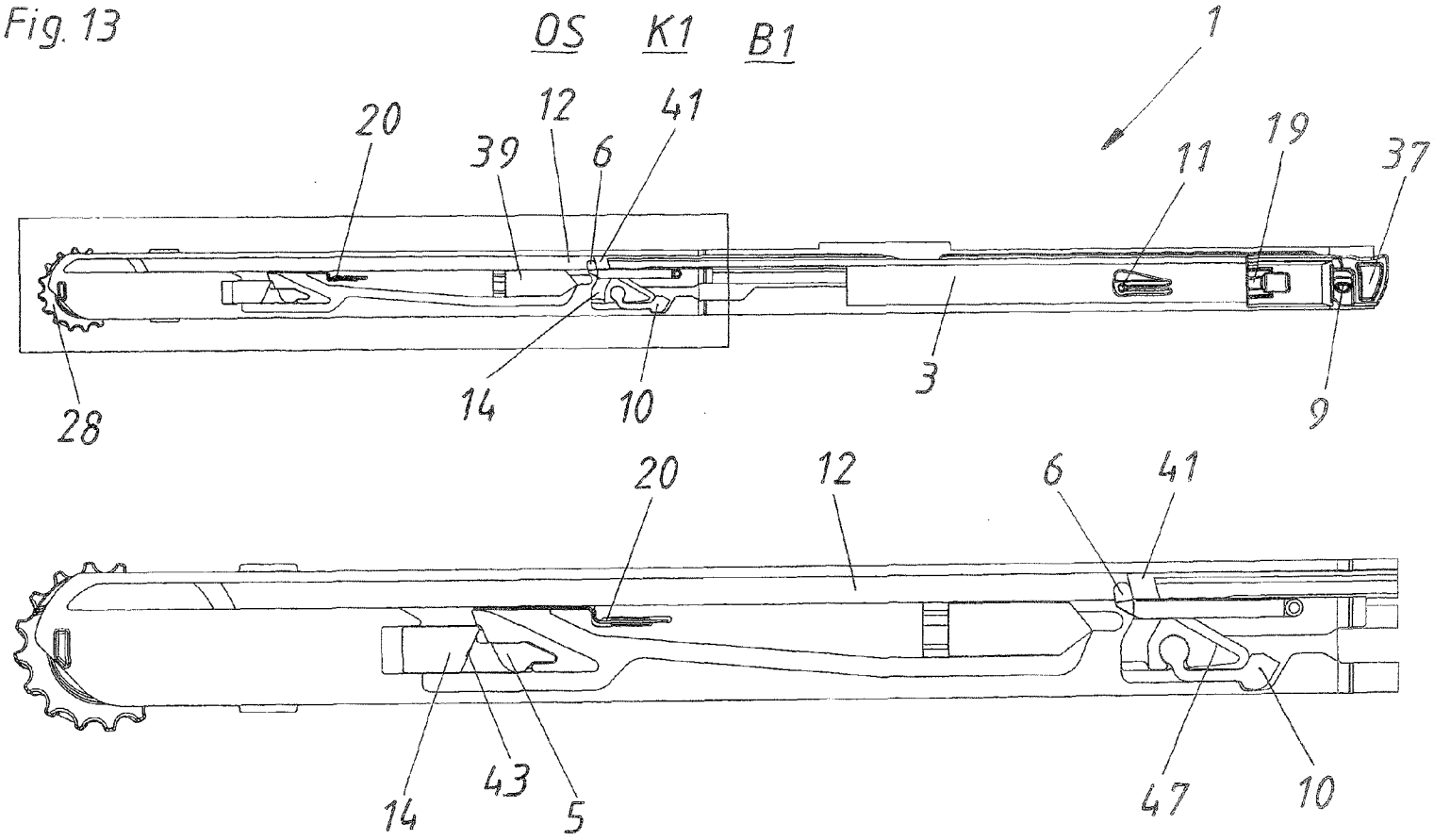
FIGS. 13 through 19 show the movements involved in closing and unlocking by over-pressing.

In FIG. 13, the drive device 1 and thus the moveable furniture part 2 are disposed in the open position OS. Similarly to FIG. 10, the latching element 6 bears against the latching element abutment 41 of the retraction slide 15 and is guided in the sliding track 12 provided in the housing center plate 26. The entire ejection slide 3 is disposed in a first movement portion B1 and the latching element 6 is disposed in the first coupling position K1. The connection to the entrainment member 9 can be seen at the other end of the retraction slide 15, by way of the catch lever 37. Partially concealed by the housing center plate 26 the transmission slide 14 is arranged moveably relative to the housing center plate 26. That transmission slide 14 also forms parts of the sliding track 12. Thus, the transmission slide for example has the locking element 5 and the inclined deflection element 43 for the latching element 6 and the inclined guide member 47 for the connecting element 11. In addition, the coupling element 10 which can correspond to the connecting element 11 is mounted pivotably to the transmission slide 14.

When the moveable furniture part 2 is further moved in the closing direction SR in FIG. 13, the latching element 6 moves along the sliding track 12 which is partly formed by the deflection element 20, while retaining the first coupling position K1. The end of the straight closing portion of the sliding track 12 and thus the end of the first movement portion B1 are reached in FIG. 14.

Figure 14:
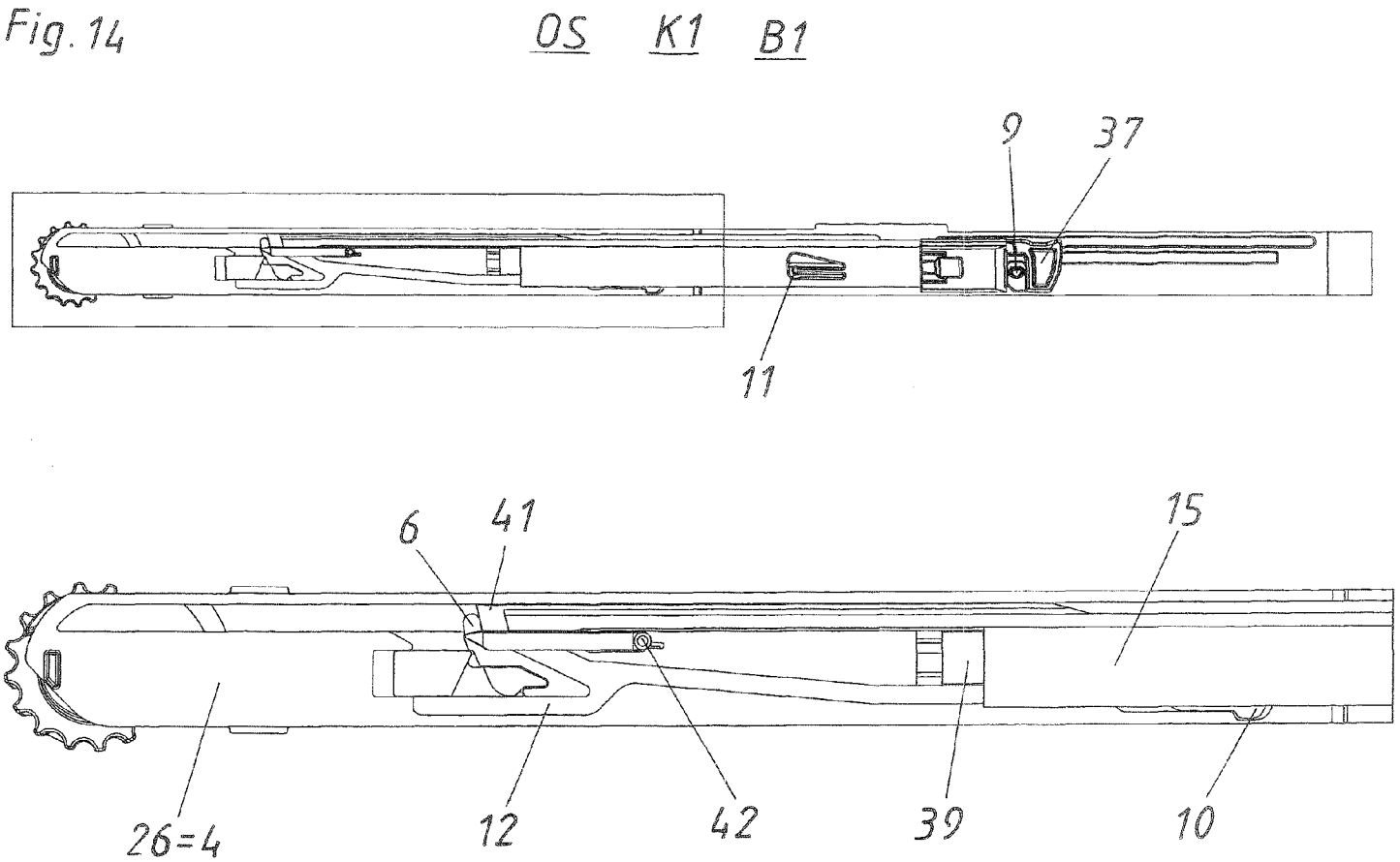
Figure 15:
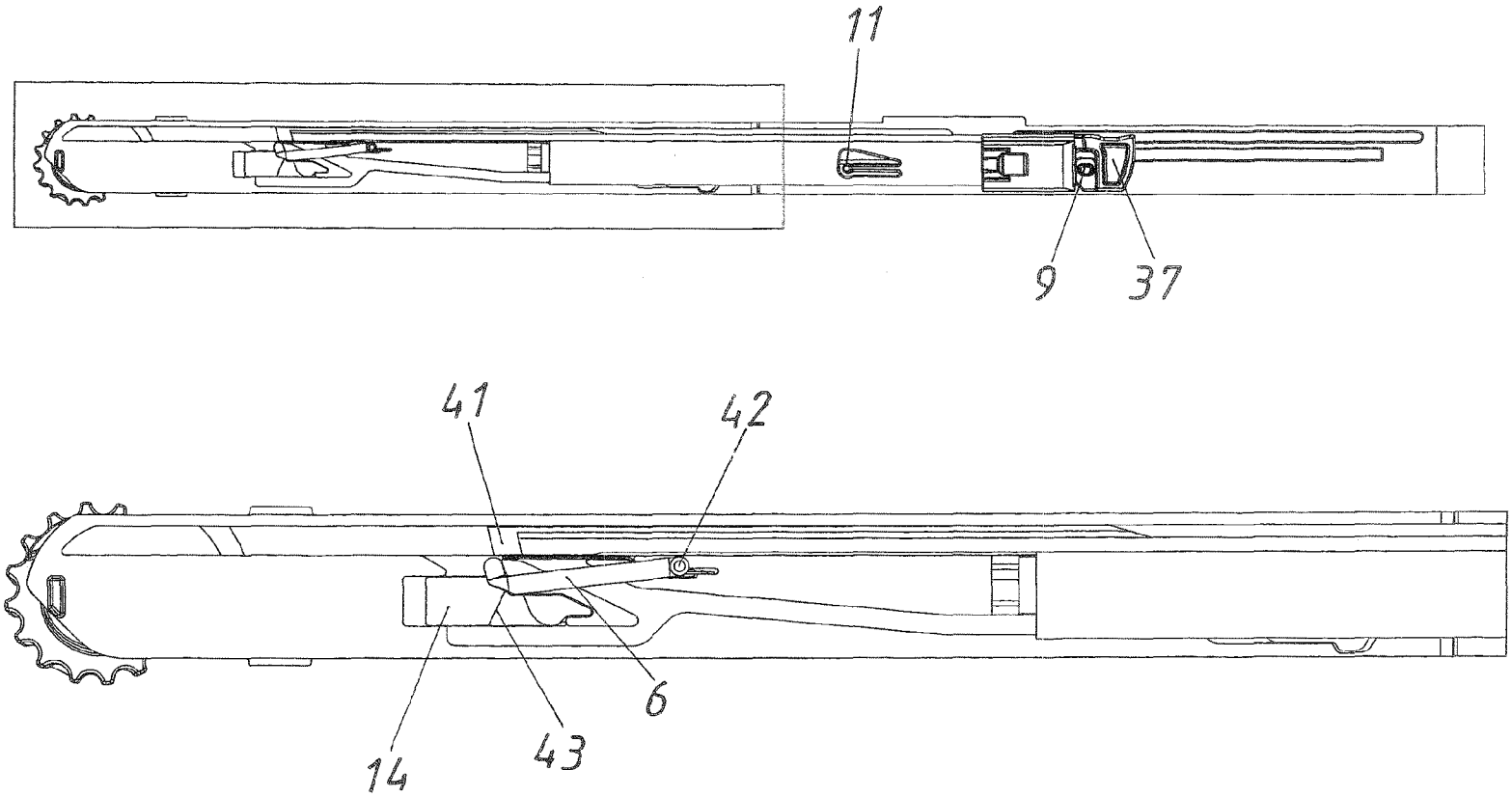

As soon as the moveable furniture part 2 is further moved from the position in FIG. 14 into the position shown in FIG. 15, the latching element 6 is urged by the latching element abutment 41 of the retraction slide 15 into the latching recess of the sliding track 12. As a result, the retraction slide 15 is uncoupled from the ejection slide 3 and at the same time the ejection slide 3 is locked to the housing 4 and the second coupling position K2 is reached. Thus, two coupling operations are implemented by that one movement of the latching element 6.

Figure 16:
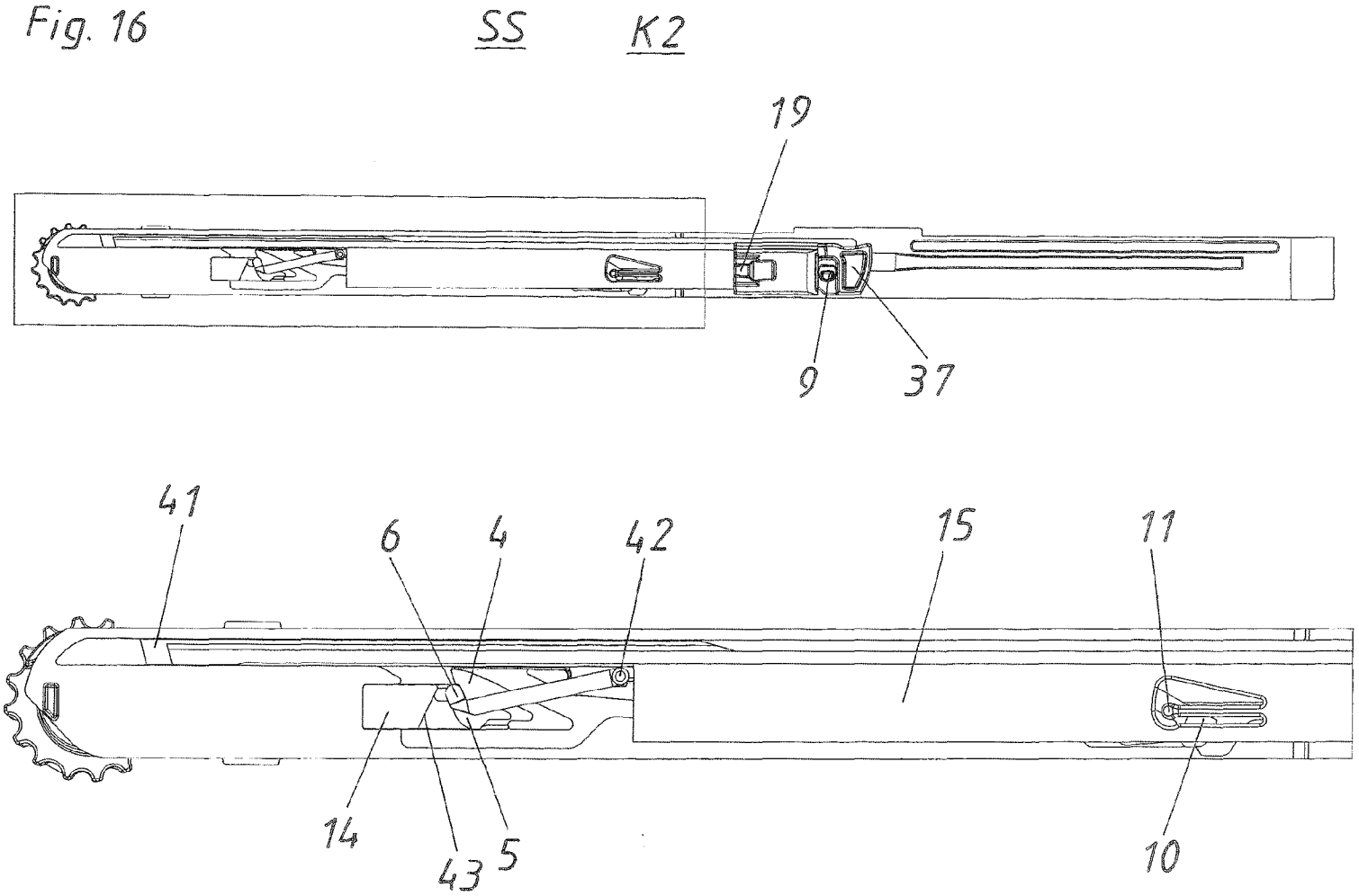

The moveable furniture part is moved or retracted from the open position OS in FIG. 15 into the closed position SS in FIG. 16 by stress relief of the retraction force storage element 19. As soon as the connecting element 11 bears against the coupling element 10 of the transmission slide 14 just before the end of that retraction movement, the entire transmission slide is firstly moved towards the left to the abutment in the housing center plate 26. After that, the connecting element 11 passes over the coupling element 10 in the closing direction SR. With that movement towards the left of the transmission slide 14, the locking element 5 is also moved towards the left and, together with a part of the sliding track 12 provided on the housing 4 (more specifically in the housing center plate 26), forms the actual latching recess 13 for the latching element 6 in the housing 4. The latching element thus remains in the second coupling position K2, even if slightly displaced in relation to FIG. 15. It can be clearly seen from FIG. 16 that the sliding track 12 now involves a cardioid shape.

Figure 17:
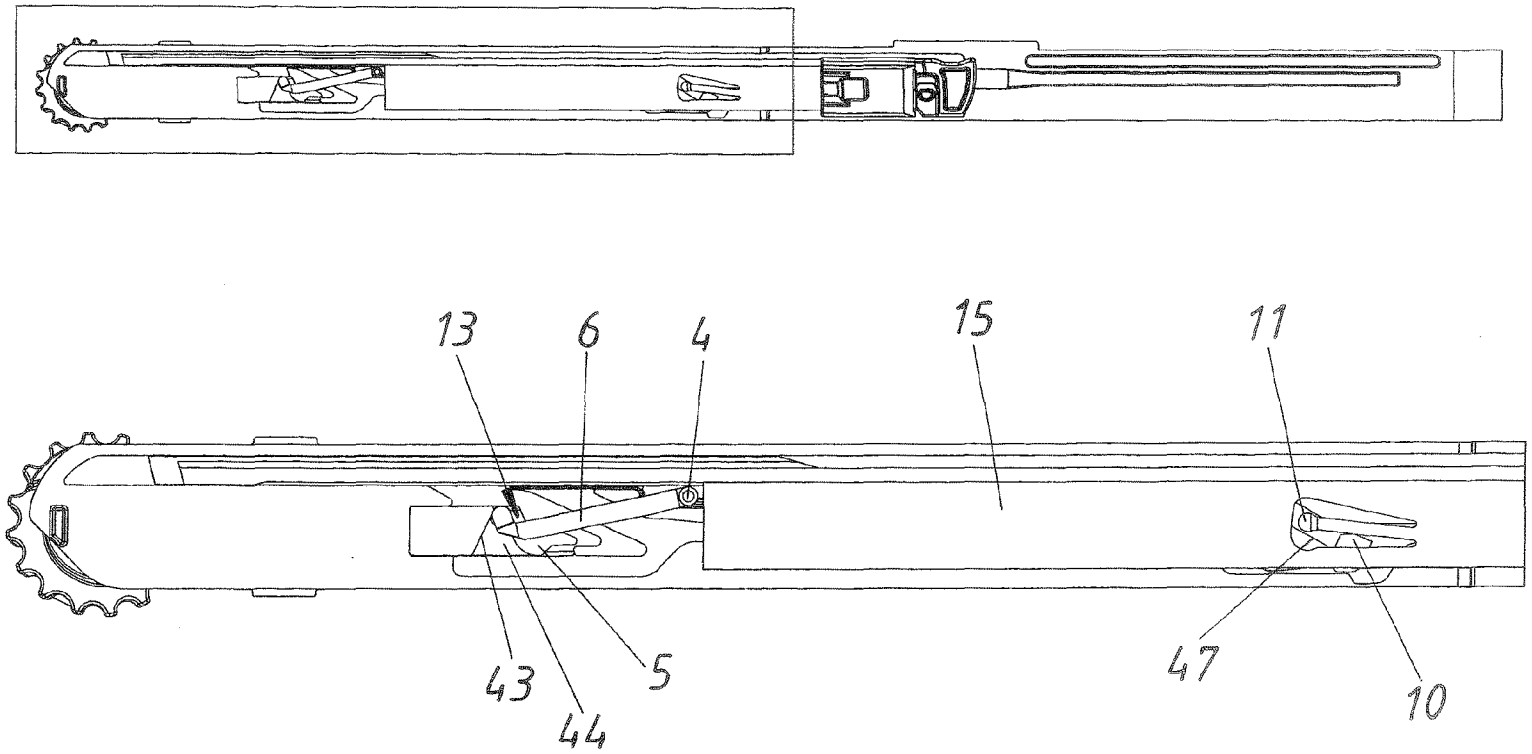
Figure 18:
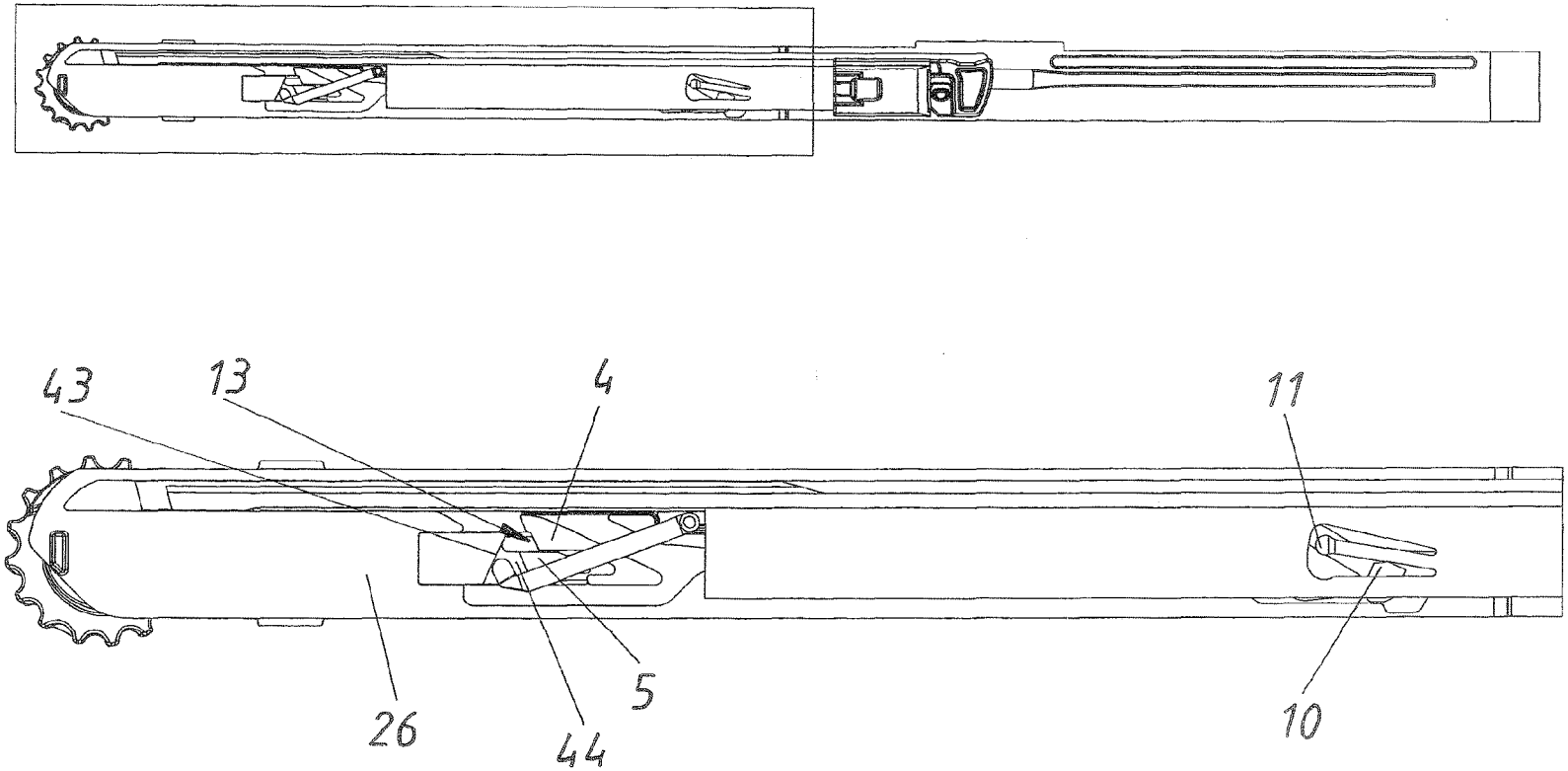

If pressure is applied to the moveable furniture part 2 in the closing direction SR in that closed position SS (see FIG. 17) the retraction slide 15 is also further moved in the closing direction SR. As that retraction slide 15 has reached an end abutment at the ejection slide 3 in that closed position SS, the ejection slide 3 is also moved in the closing direction SR together with the latching element 6 mounted pivotably thereto. As a result, the latching element 6 moves as shown in FIG. 17 out of the latching recess 13 until the latching element 6 bears against the inclined deflection element 43. The overpressed position ÜS is reached thereby. At the same time, the connection element 11 is also deflected by the inclined guide means 47.

Due to deflection at the inclined deflection element 43 (see FIG. 18), the latching element 6 further passes through the depression 44 provided in the transmission slide 14 and forming a part of the sliding track 12, in the direction of the opening portion 45 of the sliding track 12.

Figure 19:
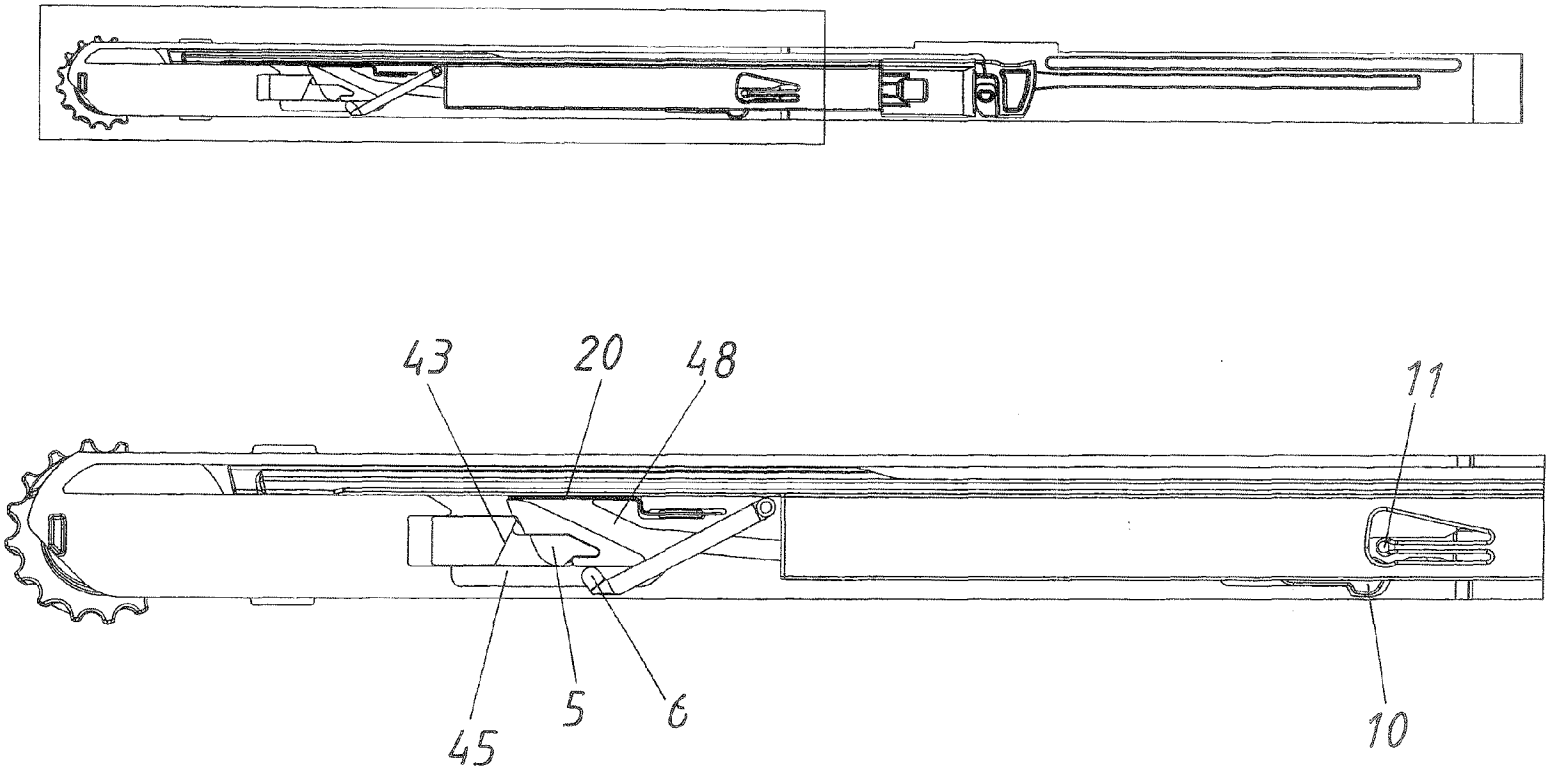
Figure 20:
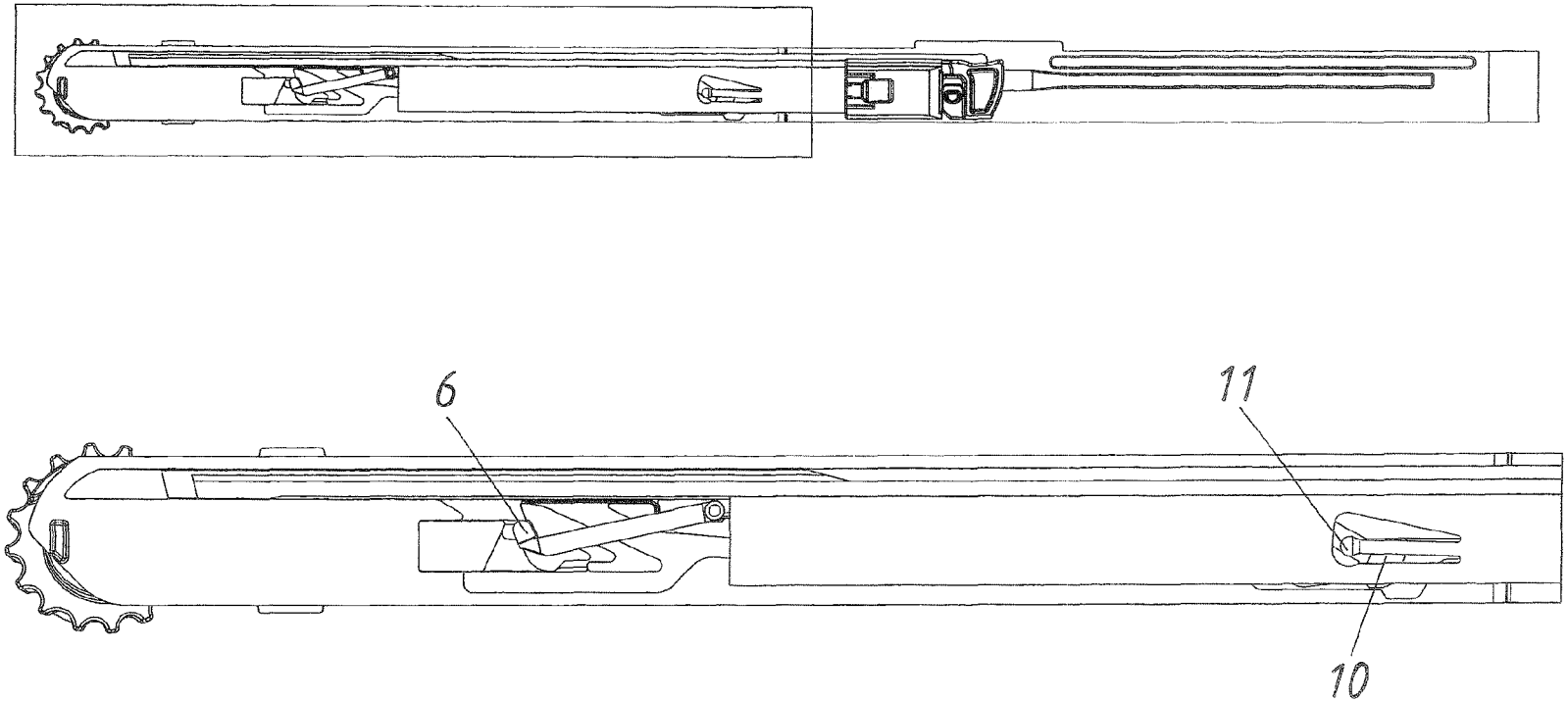
FIGS. 20 through 22 show the movements involved in unlocking by pulling, FIG. 23 diagrammatically shows the cardioid curve-like sliding track with various positions of the latching element.

As soon as that opening portion 45 is reached the ejection element 3 is unlocked and the ejection force storage member 18 can be relieved of stress and the moveable furniture part 2 is ejected in the opening direction OR and passes into the open position OS (see FIG. 19). In that ejection movement, the transmission slide 14 is moved again by the connecting element 11 by the coupling element 10 until reaching a condition of abutment a distance in the opening direction OR so that the initial position of the transmission slide 14 is restored. If the opening movement should already be interrupted shortly after the start then upon re-closing, the latching element 6 can move through the second connecting portion 48 and the latching element 6 passes into the closing portion of the sliding track 12 again, due to the deflection element 20 which is of a flap configuration being urged away.

FIG. 20 again shows the closed position SS in which the latching element 6 is in the second coupling position K2. That FIG. 20 corresponds to the view in FIG. 16.

Figure 21:
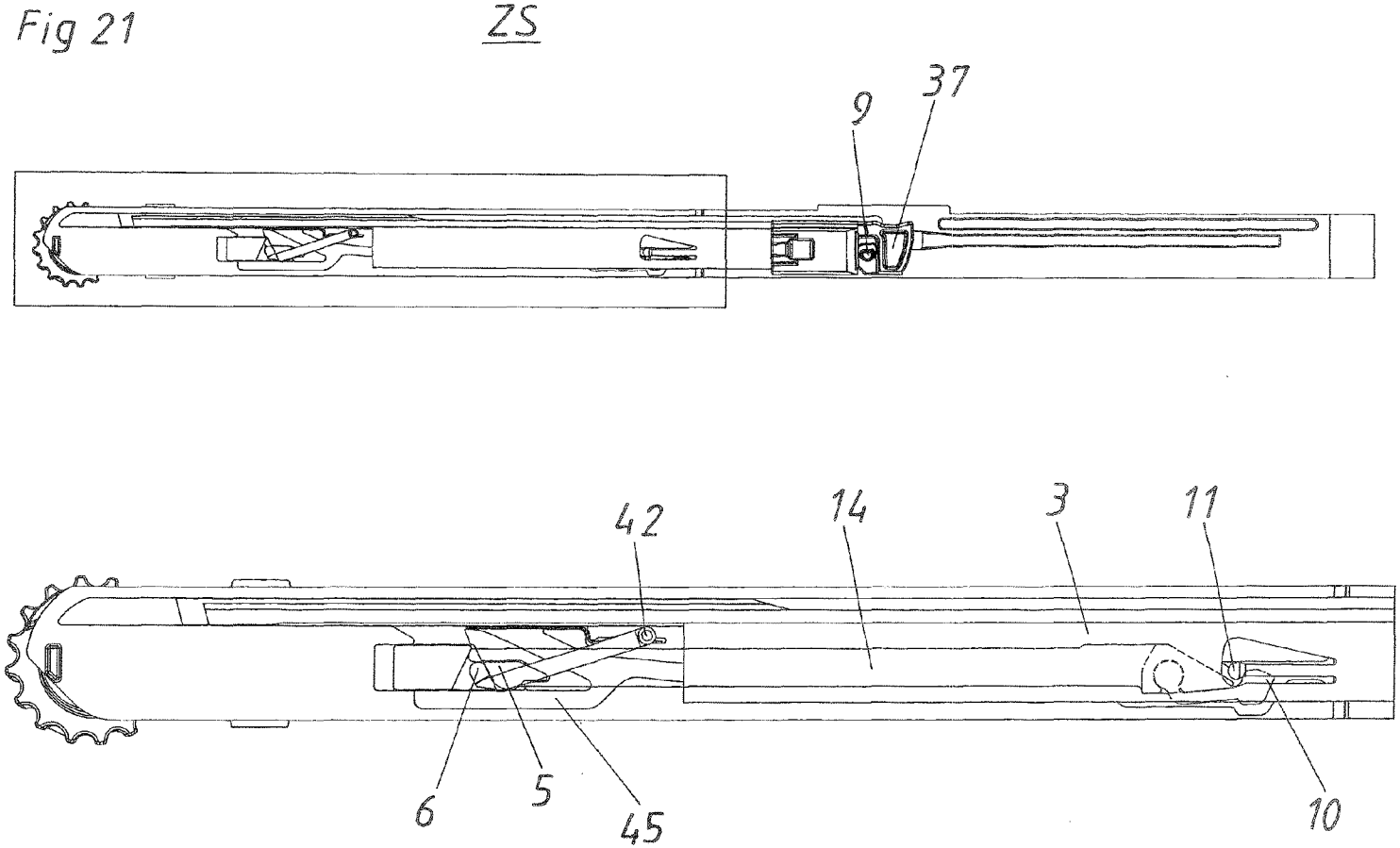

If now pressure is not applied to the moveable furniture part 2 from that closed position SS but a pulling force is applied to the moveable furniture part 2, that movement is detected by the detection device 7—which is formed by the catch lever 37 and the retraction slide 15. As a result, the retraction slide 15 and therewith the connecting element 11 are moved towards the right until it bears against the coupling element 10 and entrains it. Due to the coupling element 10 being entrained in that way, as shown in FIG. 21, the entire transmission slide 14 is also moved and the locking element 5 no longer forms a part of the latching recess 13. In that way, the path for the latching element 6 is no longed blocked by the locking element 5 and the path into the opening portion 45 of the sliding track 12 is clear. Accordingly, transmission of the pulling movement is not effected directly to the latching element 6, but so-to-speak the latching abutment (=locking element 5) is drawn away from that latching element 6 and thus the locking position or the second coupling position K2 is nullified.

Figure 22:
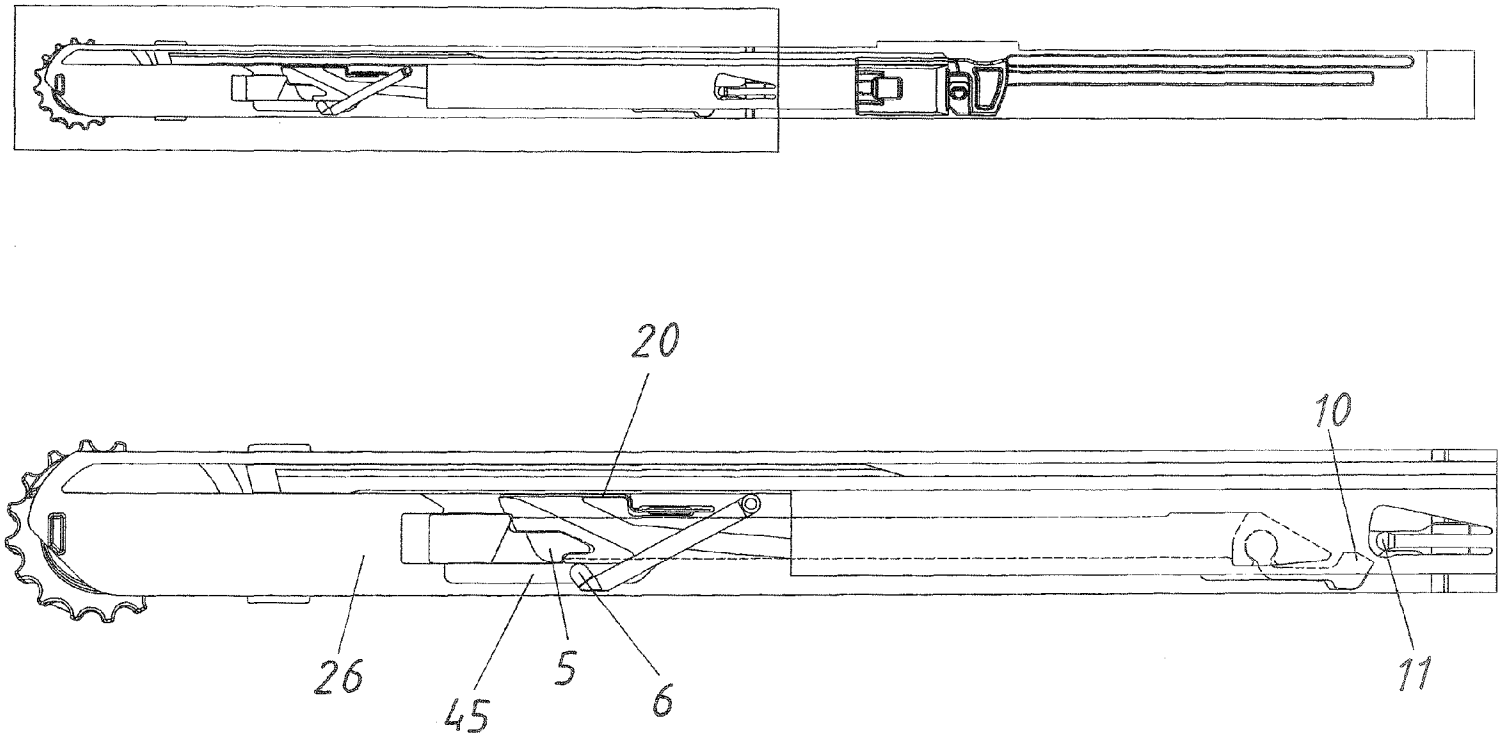

As a further consequence, as shown in FIG. 22, the ejection force storage member 18 can be relieved of stress again and, by way of the ejection slide 3 and the retraction slide 15 held thereto, moves the moveable furniture part in the opening direction OR. As soon as the ejection force storage member 18 has completely relaxed, the retraction force storage member 19 is loaded with the further momentum of the moveable furniture part 2 or by actively pulling on the moveable furniture part 2 in the opening direction OR until the first coupling position K1 between the retraction slide 15 and the ejection slide 3 is regained. Upon closure of the moveable furniture part 2, then as a further consequence the ejection force storage member 18 is stressed before the locking position or the second coupling position K2 is reached. That substantially corresponds to the first movement portion B1 which is between the positions shown in FIG. 13 and FIG. 14.

Figure 23:
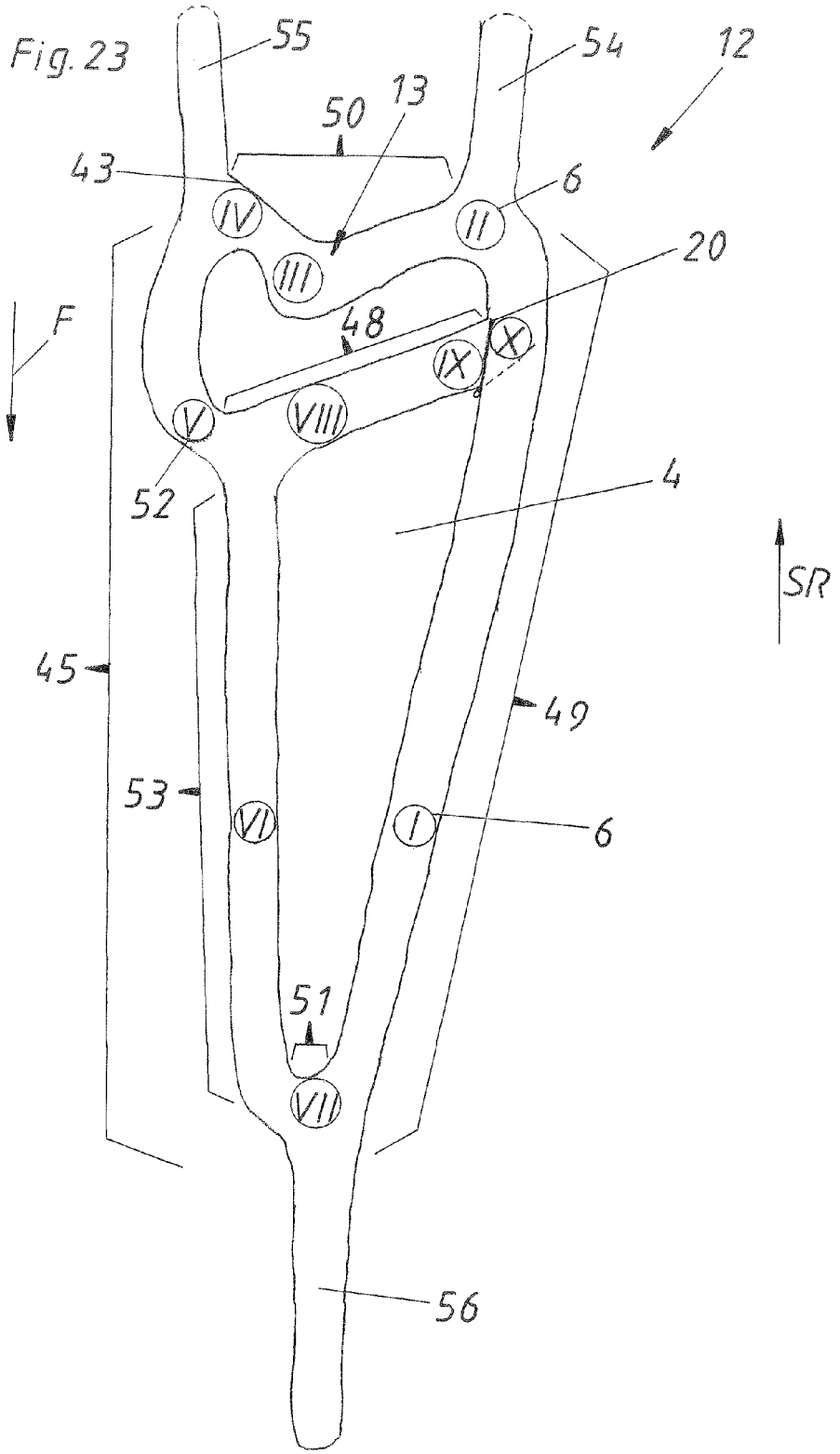

FIG. 23 diagrammatically shows a cardioid-shaped or cardioid-like sliding track 12 in which the latching element 6 moves upon opening and closing of the moveable furniture part 2. FIG. 23 shows ten different positions of the latching element 6, wherein each position of the latching element 6 is identified by Roman numerals.

After the beginning of the closing movement or the retraction movement, accordingly, the latching element 6 is disposed at position I in the closing portion 49. During the movement of the latching element 6 through that closing portion 49 in the closing direction SR, the ejection force storage member 18 (not shown here) is stressed as operation is in opposition to the spring force F of the ejection force storage member 18. Shortly before the end of the closing portion 49, the latching element 6 passes over the deflection element 20 delimiting the second connecting portion 48 and passes to the position II at the end of the opening portion 19. In the event of an excessively fast closing movement, the latching element 6 can deflect into the first overrun track 54 which is of any desired length.

Either due to the configuration of the sliding track 12 or by virtue of a travel control, the latching element 6 passes into the locking portion 50 at the finishing end of the opening portion 49 (position II). If pressure is no longer applied to the moveable furniture part 2 in that portion, then the ejection force storage member 18 can be relieved of stress. As however the latching element 6 in that position II can no longer pass into the closing portion 49, the latching element 6 is deflected by the configuration of the sliding track 12 into the latching recess 13 (see position III) and is locked there, with the ejection force storage member 18 being stressed.

If now pressure is applied to the moveable furniture part 2 in the closing direction SR, then the latching element 6 passes from the position III into the position IV (the starting end of the opening portion 45) in which it is deflected at the inclined deflection member 43 in the direction of the opening portion 45. In the case of a strong over-pressing movement, the latching element 6 could also deflect into the second overrun track 55 which is of any desired length. If pressure is no longer applied to the moveable furniture part 2 in the closing direction SR in that position IV, then the ejection force storage member 18 can be relieved of stress and the latching element 6 moves into the opening portion 45, in correspondence with the curve configuration. In the case of a normal—uninterrupted—ejection movement, the latching element 6 thereupon passes from the position V by way of the position VI to the position VII. In that position VII, the latching element is disposed in the first connecting portion 51 between the opening portion 45 and the closing portion 49. In the case of a strong ejection movement, the latching element 6 can move as far as passing into the third overrun track 56. In the closing movement, the latching element 6 then again passes into the closing portion 49 by virtue of the curve configuration and returns to the position I again.

If, however, because of incorrect operation the ejection movement of the moveable furniture part 2 is interrupted, then the latching element 6 firstly remains somewhere in the opening portion 45. For example, if that happens in the position V, then the latching element 6 can no longer be moved back into the latching recess 13. As soon as the latching element 6 has reached the front part 53 of the opening portion 45, however, (for example position VI) by virtue of the inclined deflection member 52, then, in the event of a closing movement of the moveable furniture part 2, that is triggered by the operator, the latching element 6 is deflected into the second connecting portion 48 and reaches the position VIII. Due to further closing movement, the latching element 6 moves out of the position VIII through the second connecting portion 48 to the position IX in which the latching element 6 presses against the deflection element 20 in the form of the flap, and can move that deflection element 20 into the position shown by the broken line. As a result, the latching element 6 moves into the closing portion 49 again and reaches the position X. Upon further closing movement the latching element 6 passes into the position II again and as a further consequence is locked in the latching recess 13 at position III.

Figure 24:
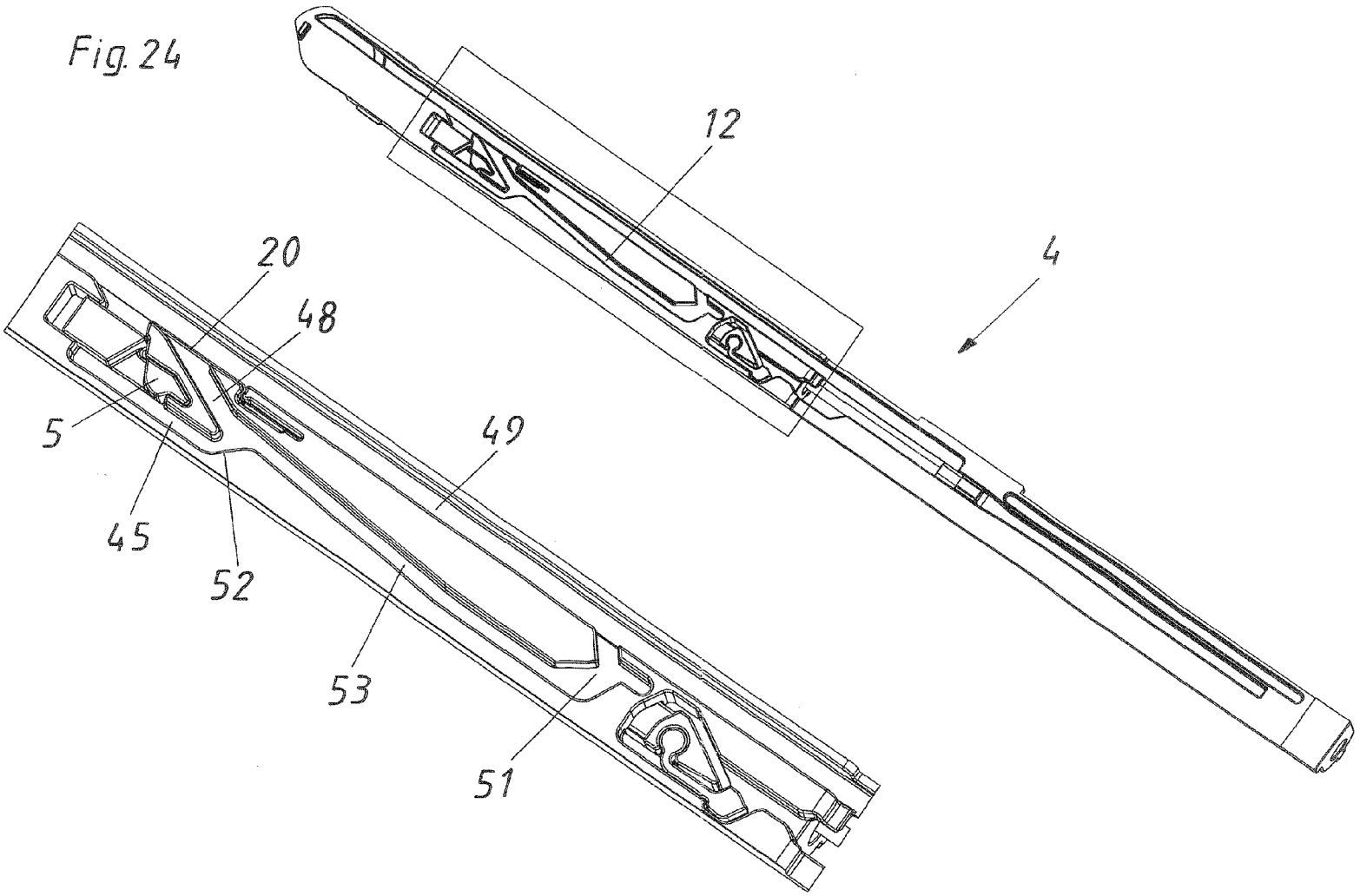
FIGS. 24 through 32 show 3D detail views of the latching element in various positions in the sliding track.

FIG. 24 shows the sliding track 12 provided in the housing 4 of an actual specific embodiment. Disposed at the end of the front part 53 of the opening portion 45 is the first connecting portion 51, by which the opening portion 45 is connected to the closing portion 49. In addition, it is possible to see the second connecting portion 48 which is delimited as far as the closing portion 49 by the deflection element 20.

Figure 25:
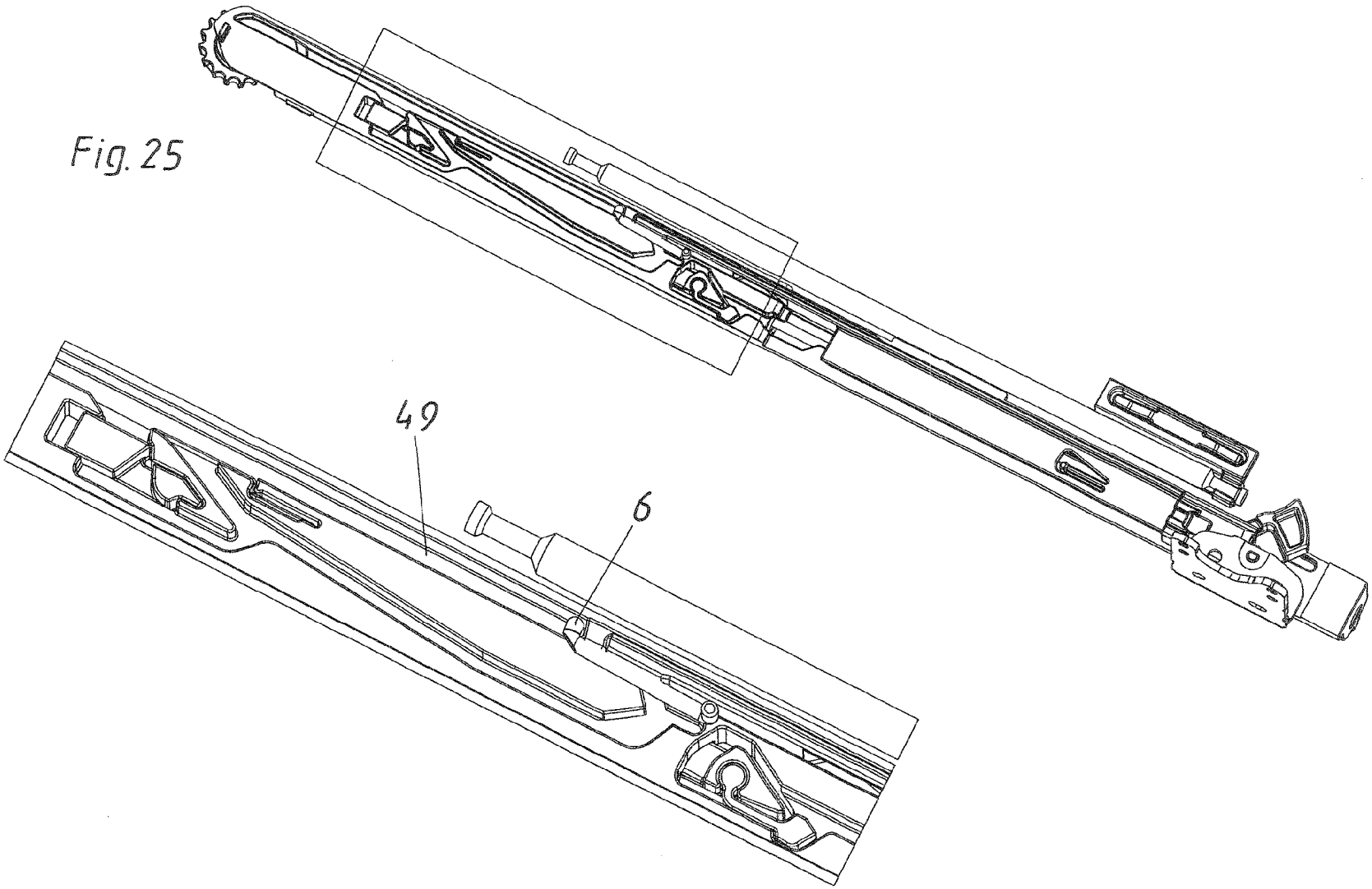

FIG. 25 additionally shows the latching element 6 which is mounted pivotably on the ejection element 3 (not shown here) and which is in the closing portion 49. That position corresponds to the position I shown in FIG. 23.

Figure 26:
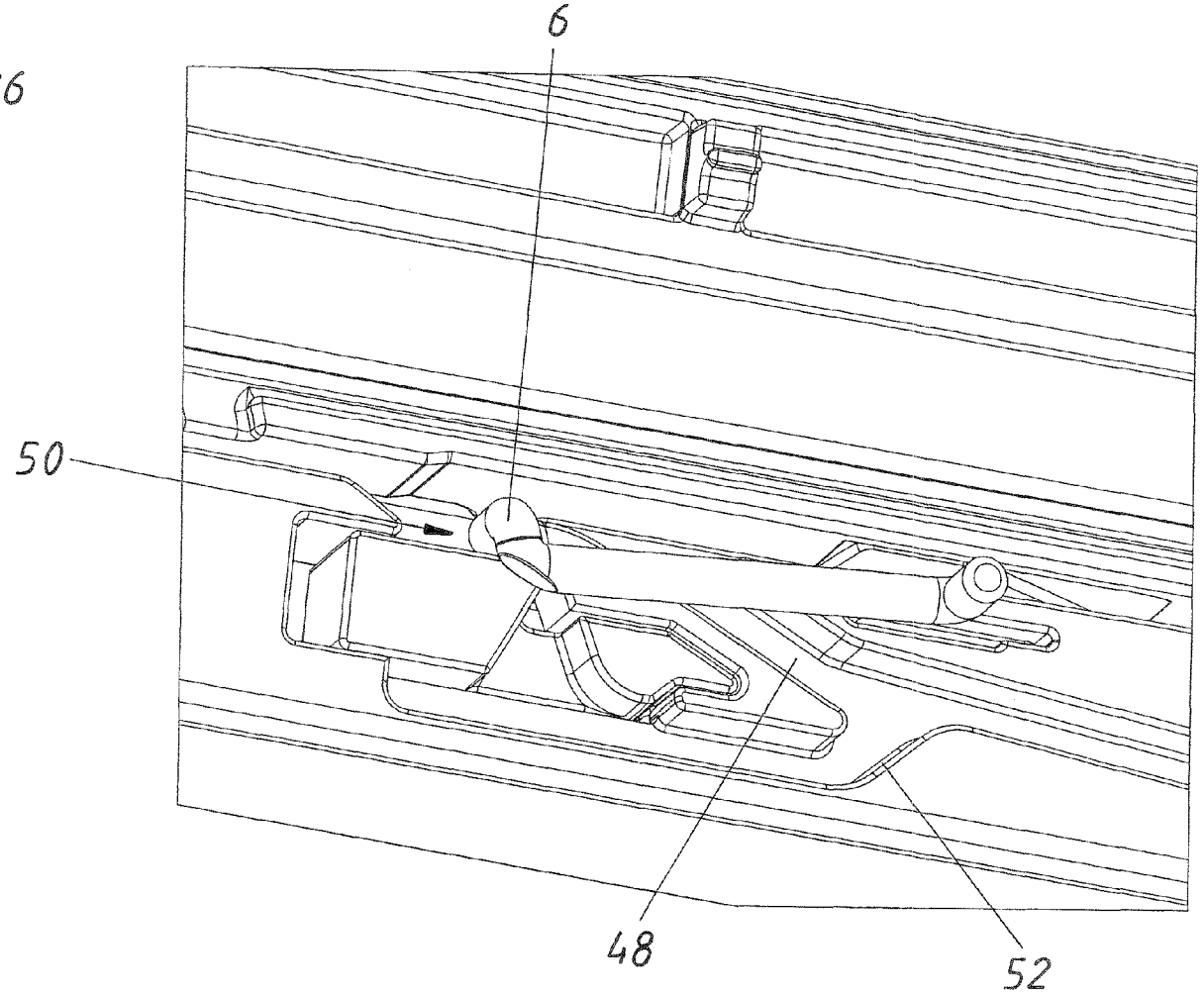

Upon further movement in the closing direction SR, the latching element 6 moves into the position shown in FIG. 26. As a result, the latching element passes into the locking portion 50. That position of the latching element 6 approximately corresponds to the position II in FIG. 23.

Figure 27:
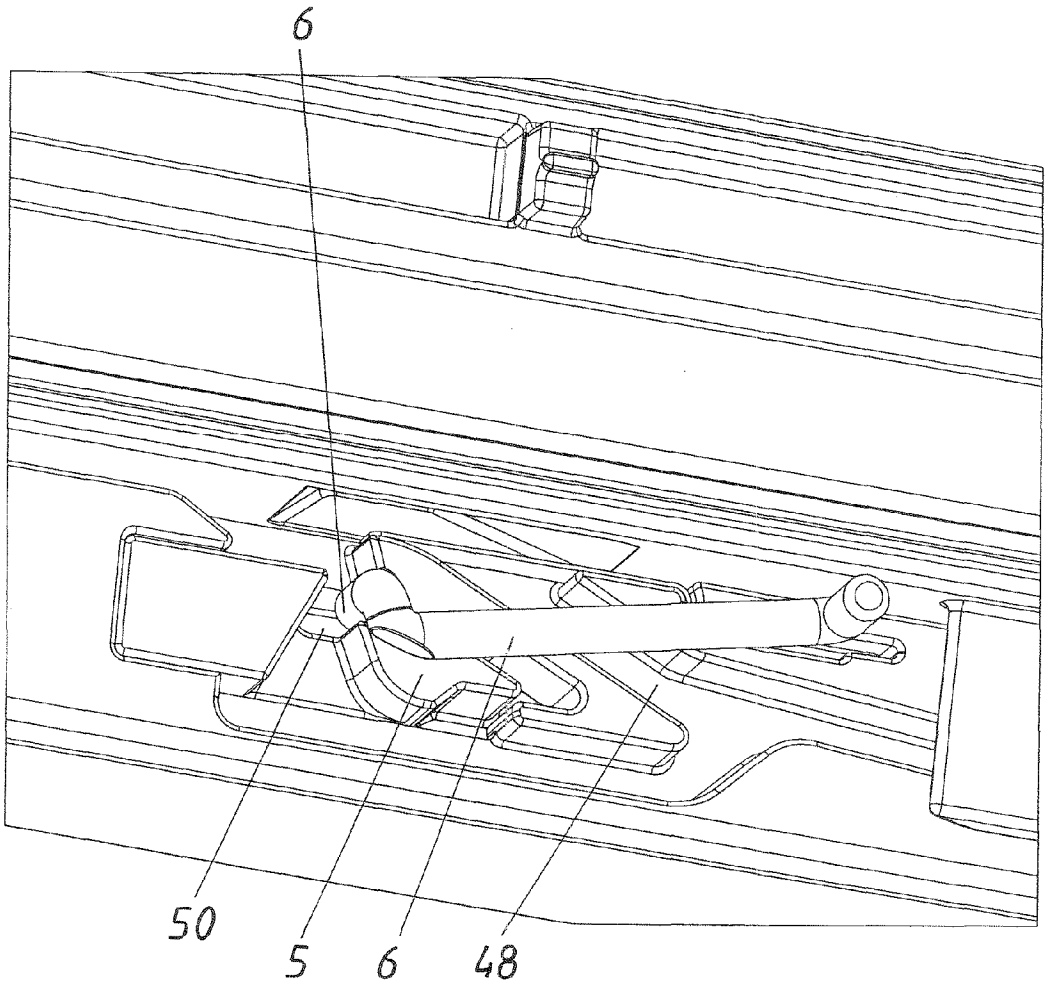
Figure 28:
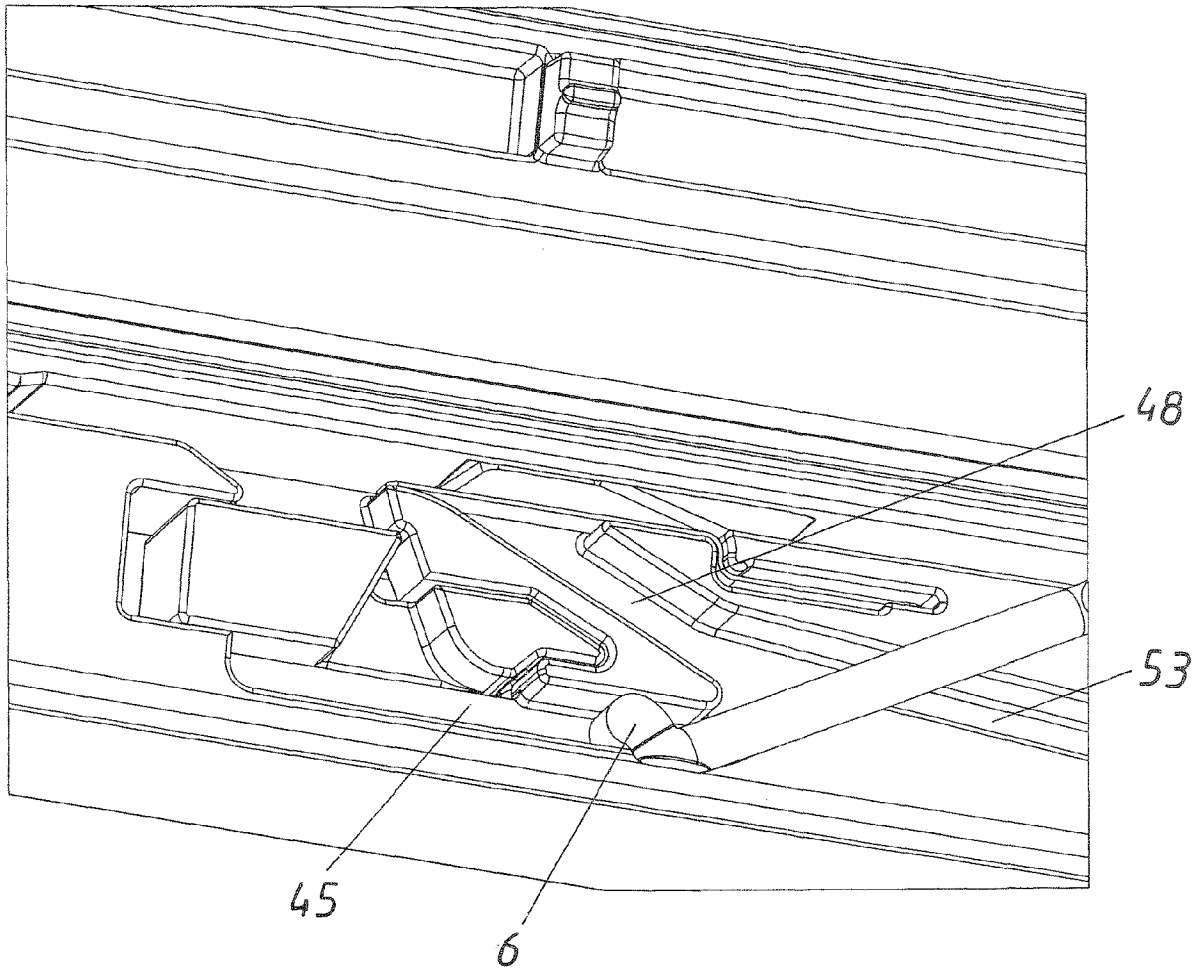
Figure 29:
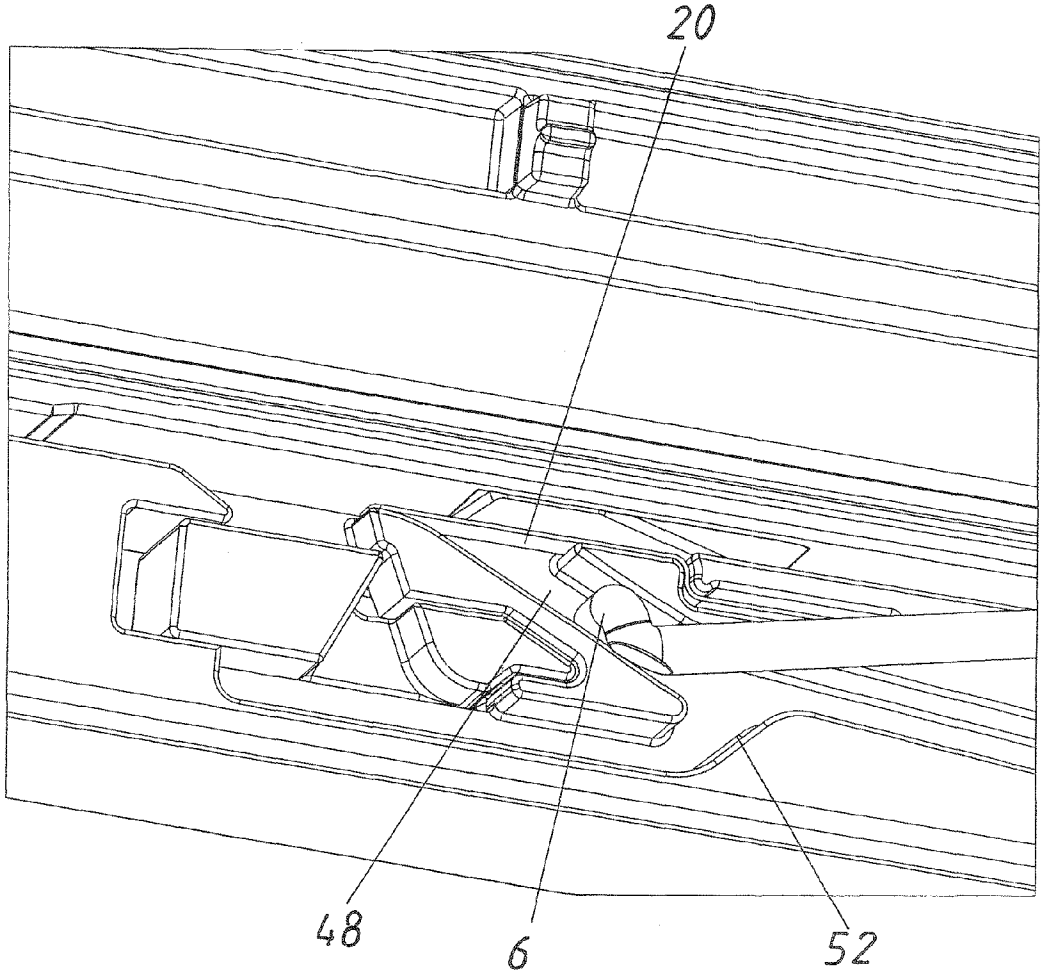

In FIG. 27 the latching element 6 is in the locking position VS in the locking portion 50. The movement in the opening direction OR is prevented by the locking element 5. That position of the latching element 6 corresponds to the position III in FIG. 23.

After unlocking (by pressing or by pulling), the latching element 6 passes into the opening portion 45. The position of the latching element 6 shown in FIG. 28 approximately corresponds to the position V shown in FIG. 23.

In the event of incorrect operation or upon an interrupted ejection movement, the latching element 6 passes into the second connecting portion 48 (see FIG. 29) by movement of the moveable furniture part 2 in the closing direction SR. That position of the latching element 6 approximately corresponds to the position VIII in FIG. 23.

Figure 30:
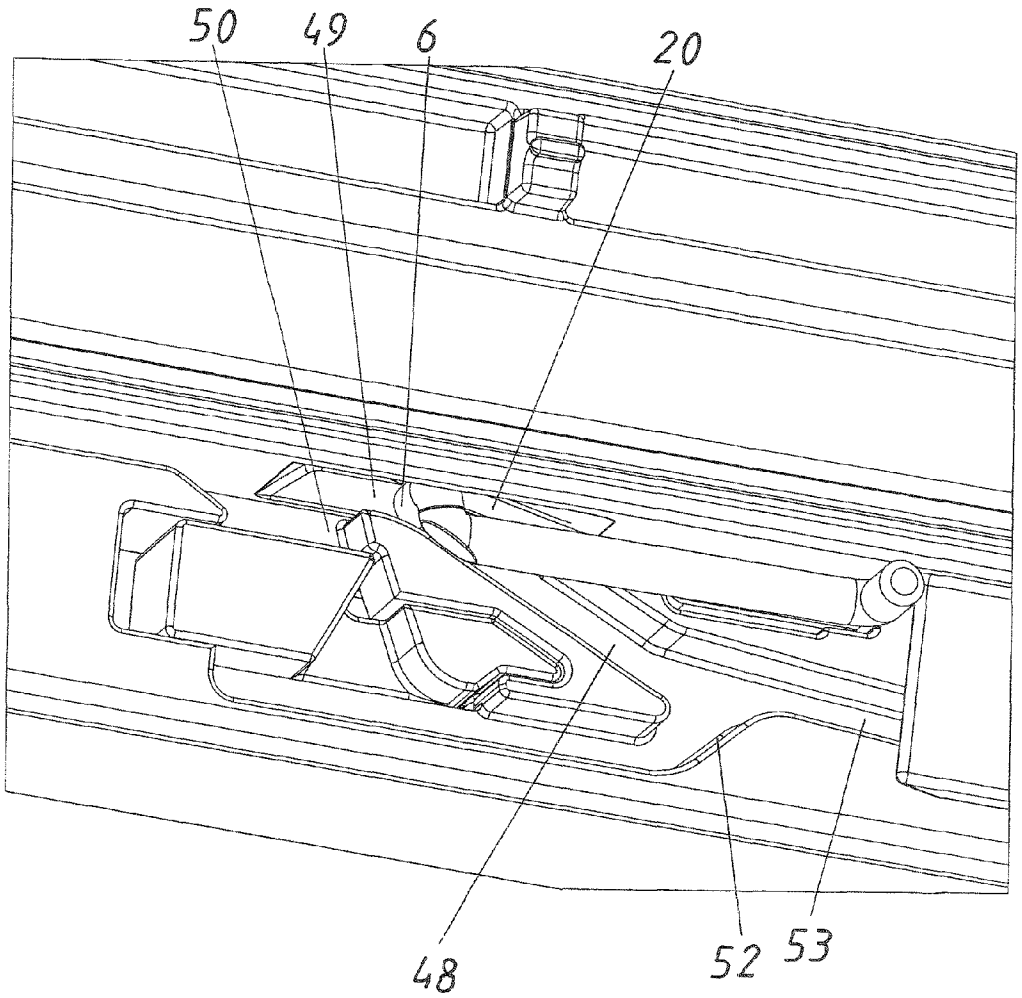

At the end of the second connecting portion 58, the latching element presses against the deflection element 20 (see FIG. 30) and thus passes into the closing portion 49. That position of the latching element 6 approximately corresponds to the position X in FIG. 23.

Figure 31:
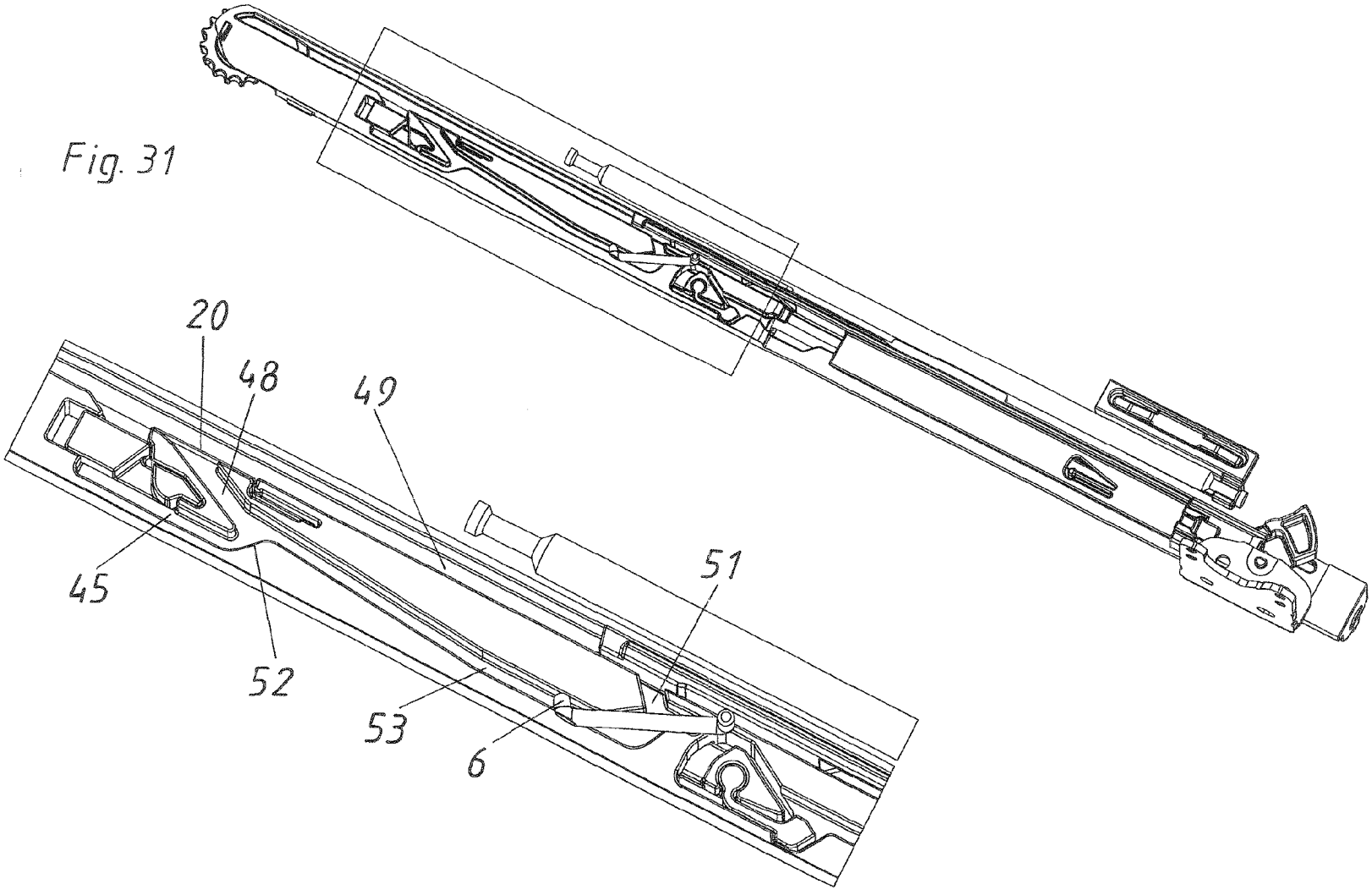

If no incorrect operation is involved, then the latching element, as shown in FIG. 31, passes by way of the front part 53 of the opening portion 45 and the first connecting portion 51 into the closing portion 49 again. The position in FIG. 31 approximately corresponds to the position VI in FIG. 23.

Figure 32:
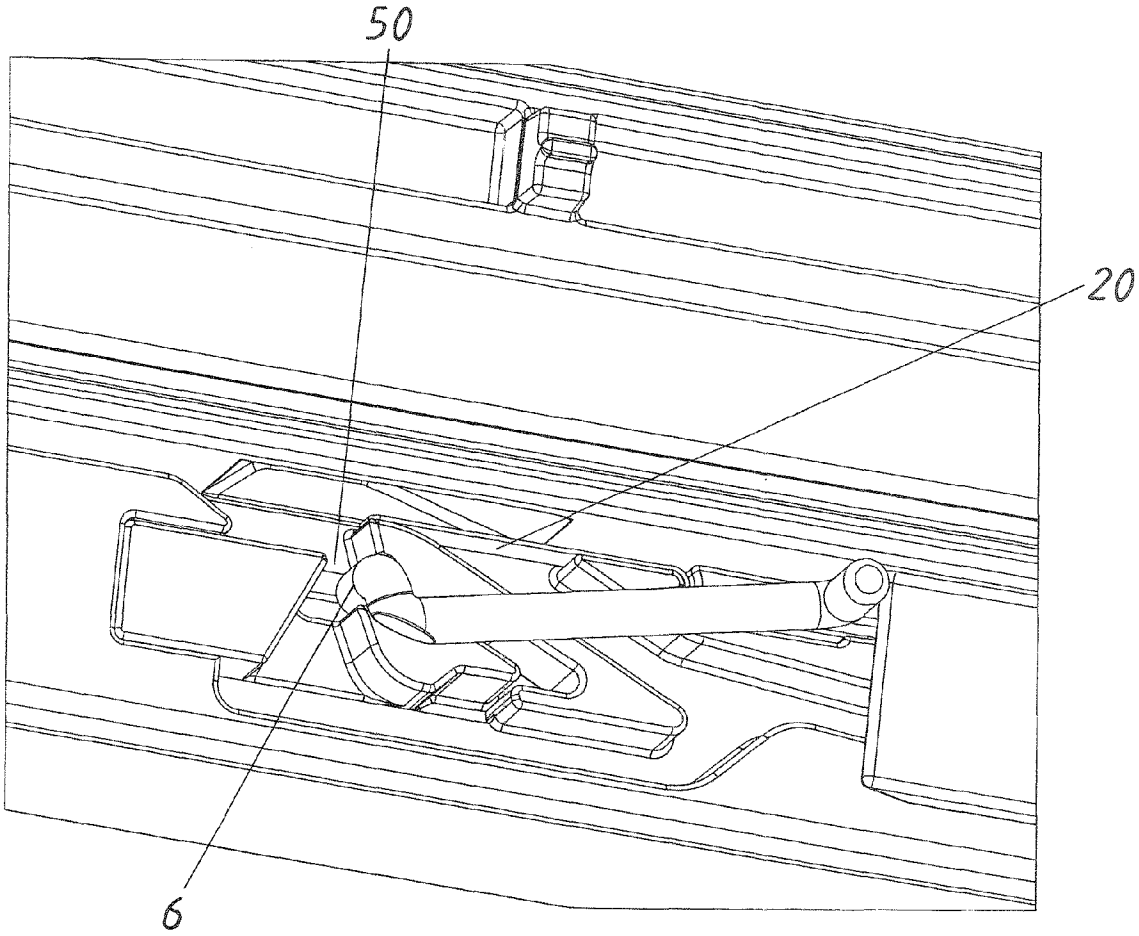

Independently of the path adopted (first connecting portion 51 or second connecting portion 48) the latching element 6 passes into the locking portion 50 again at the end of the closing movement and locks in the latching recess 13 as shown in FIG. 32. That position of the latching element 6 in FIG. 32 corresponds to the position III in FIG. 23.

The present invention thus provides an improved cardioid-like sliding track 12 for a drive device 1, in which, besides the first connecting portion 51 between the opening portion 45 and the closing portion 49, there is also a short cut in the form of the second connecting portion 48 between the opening portion 45 and the closing portion 49 in the housing 4 as part of the sliding track 12.

The invention claimed is:

1. A drive device for moving a moveable furniture part, comprising:

a cardioid-shaped sliding track; and a latching element displaceable within said cardioid-shaped sliding track;

wherein said sliding track has:

a closing portion through which said latching element moves upon closing of the moveable furniture part;

a locking portion having a latching recess in which said latching element is held in a locking position;

an opening portion through which said latching element moves upon opening of the moveable furniture part;

a first connecting portion configured to allow said latching element to move from said opening portion into said closing portion when the furniture part is opened; and a second connecting portion located closer than said first connecting portion to said latching recess, said second connecting portion directly connecting said opening portion and said closing portion such that, upon the closing of the moveable furniture part, said latching element is moveable directly from said opening portion to said closing portion through said second connecting portion without moving through said locking portion; wherein said sliding track is configured such that, after the latching element passes through either of said closing portion or said second connecting portion during closing of the movable furniture part, said latching element is held in said latching recess.

2. The drive device as set forth in claim 1, further comprising a flap-shaped deflection element between said second connecting portion and said closing portion.

3. The drive device as set forth in claim 1, wherein said opening portion has an inclined deflection member configured to deflect said latching element during an opening movement into a part of said opening portion, said part being located between said first connecting portion and said second connecting portion.

4. The drive device as set forth in claim 3, wherein said sliding track is configured such that said latching element passes into said second connecting portion upon movement of said latching element in a closing direction through said part of said opening portion.

5. The drive device as set forth in claim 1, further comprising a housing, said sliding track being arranged in said housing.

6. The drive device as set forth in claim 5, further comprising an ejection element and an ejection force storage member acting upon said ejection element, said ejection element being moveable relative to said housing for moving the moveable furniture part.

7. The drive device as set forth in claim 6, wherein said latching element is pivotably mounted to said ejection element.

8. An article of furniture comprising:

a furniture carcass;

a moveable furniture part; and said drive device as set forth in claim 1 for moving said moveable furniture part.

9. A drive device for moving a moveable furniture part, comprising:

a cardioid-shaped sliding track;

a latching element displaceable within said cardioid-shaped sliding track, said sliding track having:

a closing portion through which said latching element moves upon closing of the moveable furniture part;

a locking portion having a latching recess in which said latching element is held in a locking position;

an opening portion through which said latching element moves upon opening of the moveable furniture part;

a first connecting portion configured to allow said latching element to move from said opening portion into said closing portion when the furniture part is opened; and a second connecting portion located closer than said first connecting portion to said latching recess, said second connecting portion being located between said opening portion and said closing portion; wherein said sliding track is configured such that, after the latching element passes through either of said closing portion or said second connecting portion during closing of the movable furniture part, said latching element is held in said latching recess; and an overrun track directly connected to said closing portion of said sliding track such that, upon the closing of the moveable furniture part, said latching element is moveable from said first connecting portion through said closing portion directly into said overrun track, and is moveable from said second connecting portion through said closing portion and into said overrun track.

10. The drive device as set forth in claim 9, further comprising a flap-shaped deflection element between said second connecting portion and said closing portion.

11. The drive device as set forth in claim 9, wherein said opening portion has an inclined deflection member configured to deflect said latching element during an opening movement into a part of said opening portion, said part being located between said first connecting portion and said second connecting portion.

12. The drive device as set forth in claim 11, wherein said sliding track is configured such that said latching element passes into said second connecting portion upon movement of said latching element in a closing direction through said part of said opening portion.

13. The drive device as set forth in claim 9, further comprising a housing, said sliding track being arranged in said housing.

14. The drive device as set forth in claim 13, further comprising an ejection element and an ejection force storage member acting upon said ejection element, said ejection element being moveable relative to said housing for moving the moveable furniture part.

15. A drive device for moving a moveable furniture part, comprising:

a cardioid-shaped sliding track; and a latching element displaceable within said cardioid-shaped sliding track;

wherein said sliding track has:

a closing portion through which said latching element moves upon closing of the moveable furniture part;

a locking portion having a latching recess in which said latching element is held in a locking position;

an opening portion through which said latching element moves upon opening of the moveable furniture part;

a first connecting portion configured to allow said latching element to move from said opening portion into said closing portion when the furniture part is opened; and a second connecting portion located closer than said first connecting portion to said latching recess, said second connecting portion being located between said opening portion and said closing portion wherein said sliding track is configured such that said latching recess of said locking portion is only accessible by said latching element via a finishing end of said closing portion and a starting end of said opening portion; said sliding track is configured such that, after the latching element passes through either of said closing portion or said second connecting portion during closing of the movable furniture part, said latching element is held in said latching recess.

16. The drive device as set forth in claim 15, further comprising a flap-shaped deflection element between said second connecting portion and said closing portion.

17. The drive device as set forth in claim 15, wherein said opening portion has an inclined deflection member configured to deflect said latching element during an opening movement into a part of said opening portion, said part being located between said first connecting portion and said second connecting portion.

18. The drive device as set forth in claim 17, wherein said sliding track is configured such that said latching element passes into said second connecting portion upon movement of said latching element in a closing direction through said part of said opening portion.

19. The drive device as set forth in claim 15, further comprising a housing, said sliding track being arranged in said housing.

20. The drive device as set forth in claim 19, further comprising an ejection element and an ejection force storage member acting upon said ejection element, said ejection element being moveable relative to said housing for moving the moveable furniture part.

* * * * *